US009065225B2

(12) United States Patent
Degner et al.

(10) Patent No.: US 9,065,225 B2
(45) Date of Patent: Jun. 23, 2015

(54) EDGE CONNECTOR HAVING A HIGH-DENSITY OF CONTACTS

(71) Applicant: Apple Inc., Cupertino, CA (US)

(72) Inventors: Brett W. Degner, Menlo Park, CA (US); Mahmoud Amini, Sunnyvale, CA (US); William P. Cornelius, Los Gatos, CA (US); Zheng Gao, San Jose, CA (US); Aaron P. Miletich, San Jose, CA (US); George Marc Simmel, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 123 days.

(21) Appl. No.: 13/871,765

(22) Filed: Apr. 26, 2013

(65) Prior Publication Data

US 2013/0288534 A1 Oct. 31, 2013

Related U.S. Application Data

(60) Provisional application No. 61/639,061, filed on Apr. 26, 2012.

(51) Int. Cl.

| | |
|---|---|
| ***H01R 12/72*** | (2011.01) |
| ***H01R 43/00*** | (2006.01) |
| ***H01R 12/73*** | (2011.01) |

(52) U.S. Cl.

CPC ..... *H01R 12/721* (2013.01); *H01R 43/00* (2013.01); *Y10T 29/49204* (2015.01); *H01R 12/737* (2013.01)

(58) Field of Classification Search

CPC ..... H01R 12/721

USPC ..... 439/637

See application file for complete search history.

(56) References Cited

U.S. PATENT DOCUMENTS

| | | | | | |
|---|---|---|---|---|---|
| 3,631,381 | A | * | 12/1971 | Pittman | 439/637 |
| 3,744,005 | A | * | 7/1973 | Sitzler | 439/260 |
| 4,298,237 | A | * | 11/1981 | Griffith et al. | 439/60 |
| 4,659,155 | A | * | 4/1987 | Walkup et al. | 439/108 |
| 4,806,103 | A | * | 2/1989 | Kniese et al. | 439/60 |
| 4,904,197 | A | * | 2/1990 | Cabourne | 439/260 |
| 4,969,824 | A | * | 11/1990 | Casciotti | 439/62 |
| 4,993,972 | A | * | 2/1991 | Lin | 439/637 |
| 5,024,609 | A | * | 6/1991 | Piorunneck | 439/637 |
| 5,026,292 | A | * | 6/1991 | Pickles et al. | 439/108 |
| 5,051,099 | A | * | 9/1991 | Pickles et al. | 439/108 |
| 5,197,887 | A | * | 3/1993 | Davidge et al. | 439/60 |
| 5,239,748 | A | * | 8/1993 | Hamilton | 29/843 |
| 5,496,180 | A | * | 3/1996 | Fabian et al. | 439/60 |
| 5,522,737 | A | * | 6/1996 | Brunker et al. | 439/637 |

(Continued)

*Primary Examiner* — Ross Gushi

(74) *Attorney, Agent, or Firm* — Kilpatrick Townsend & Stockton LLP

(57) ABSTRACT

High-speed connectors having a high density of contacts may be provided. One example may provide a connector having a housing with a slot forming an opening in a top side. The slot and opening may be arranged to receive a card. This connector may provide a high density of contacts by arranging the contacts in multiple rows in the slot. Various contacts may include barbs to be inserted into the housing. The barbs may be angled and may have one or more teeth to help anchor the contacts in place. A conductive or nonconductive shield or shell may be placed over the housing. When a conductive shield is used, metal pins may be inserted into the housing for mechanical stability and secured to the shield, and various contacts may have contacting portions in contact with the shield to improve signal integrity.

21 Claims, 24 Drawing Sheets

(56) References Cited

U.S. PATENT DOCUMENTS

| | | | | |
|---|---|---|---|---|
| 5,634,819 | A * | 6/1997 | Pan et al. | 439/637 |
| 5,730,609 | A * | 3/1998 | Harwath | 439/108 |
| 5,813,883 | A * | 9/1998 | Lin | 439/637 |
| 5,820,392 | A * | 10/1998 | Lin et al. | 439/108 |
| 5,876,214 | A * | 3/1999 | McHugh et al. | 439/60 |
| 5,997,312 | A * | 12/1999 | Ho et al. | 439/60 |
| 6,019,639 | A * | 2/2000 | Brunker et al. | 439/637 |
| 6,099,328 | A * | 8/2000 | Nelson et al. | 439/101 |
| 6,220,868 | B1 * | 4/2001 | Pei et al. | 439/60 |
| 6,254,435 | B1 * | 7/2001 | Cheong et al. | 439/637 |
| 6,309,254 | B1 * | 10/2001 | Korsunsky | 439/637 |
| 6,328,605 | B1 * | 12/2001 | Walker et al. | 439/631 |
| 6,439,930 | B1 * | 8/2002 | Korsunsky et al. | 439/637 |
| 6,464,537 | B1 * | 10/2002 | Letourneau et al. | 439/607.14 |
| 6,508,675 | B1 * | 1/2003 | Korsunsky et al. | 439/637 |
| 6,561,850 | B2 * | 5/2003 | Letourneau et al. | 439/607.08 |
| 6,634,889 | B2 * | 10/2003 | Miller et al. | 439/60 |
| 6,645,012 | B2 * | 11/2003 | Ito et al. | 439/637 |
| 6,652,322 | B2 * | 11/2003 | Ito et al. | 439/637 |
| 7,040,934 | B2 * | 5/2006 | Ling et al. | 439/682 |
| 7,607,949 | B2 * | 10/2009 | Hsu | 439/637 |
| 7,628,654 | B2 * | 12/2009 | Hori et al. | 439/637 |
| 7,637,783 | B2 * | 12/2009 | Sasaoka et al. | 439/637 |
| 7,748,988 | B2 * | 7/2010 | Hori et al. | 439/60 |
| 8,113,887 | B2 * | 2/2012 | Osawa et al. | 439/637 |
| 8,187,038 | B2 * | 5/2012 | Kamiya et al. | 439/637 |
| 8,672,713 | B2 * | 3/2014 | Tajiri et al. | 439/630 |
| 8,696,389 | B2 * | 4/2014 | Mason et al. | 439/637 |
| 2005/0042928 | A1 * | 2/2005 | Yi et al. | 439/637 |
| 2009/0191764 | A1 * | 7/2009 | Hori et al. | 439/637 |
| 2011/0021080 | A1 * | 1/2011 | Kamiya et al. | 439/637 |
| 2013/0084754 | A1 * | 4/2013 | Mason et al. | 439/637 |
| 2013/0288534 | A1 * | 10/2013 | Degner et al. | 439/630 |

* cited by examiner

EDGE CONNECTOR HAVING A HIGH-DENSITY OF CONTACTS

CROSS-REFERENCES TO RELATED APPLICATIONS

This application is a nonprovisional of U.S. provisional patent No. 61/639,061, filed Apr. 26, 2012, which is incorporated by reference.

BACKGROUND

The number and types of electronic devices available to consumers have increased tremendously the past few years, and this increase shows no signs of abating. Devices such as portable computers; tablet, desktop, and all-in-one computers; cell, smart, and media phones; storage devices; portable media players; navigation systems; monitors; and others have become ubiquitous.

The complexity of these devices has similarly been increasing. Additional functionality, such as graphics processing, networking, increases in memory size, and others, has led to an increase in the number and types of circuits included in these devices. These circuits may be located on boards, such as main-logic boards, in these devices.

However, due to increases in complexity, it is becoming more difficult to include all these needed circuits on one board. Also, there is a desire to be able to customize devices to target user preferences and varying price points. These factors have led to an increase in the use of daughter or riser cards. These cards may include various circuits. A card may connect to main-logic board via contacts along an edge of the card, where the edge of the card may plug into a corresponding connector on the main-logic board. Use of these cards allows functionality to be moved off the main-logic board, and also allows different cards to be used in different device configurations.

Unfortunately, these connectors may consume space on the main-logic board. This increased space means the main-logic board can either support less functionality or has to grow correspondingly larger. The latter may also mean that the entire electronic device may have to increase in size.

Also, these connectors may degrade signal quality and high-speed performance. Specifically, a signal traveling from a circuit on a card to a circuit on a main-logic board may need to travel along a trace on the card to a contact at an edge of the card, then through a connector joining the card to the main-logic board. From there, the signal needs to travel along a trace on the main-logic board itself. These multiple connections may increase signal path resistance and reactance, as well as signal coupling, thereby degrading signal quality.

Cards supported by these connectors may also be of considerable size, weight, and complexity. A large mass may place high rotational, lateral, and other forces on the connector.

Thus, what is needed are connectors having a high density of contacts that may also provide improved performance at high-speeds and be robust enough for use with large, heavy cards.

SUMMARY

Accordingly, embodiments of the present invention may provide high-speed connectors that may have a high density of contacts, may provide improved performance at high speeds, and may be robust for use with large, complex cards.

An illustrative embodiment of the present invention may provide a connector for mating a daughter, riser, or other board, card, or device to a printed circuit board, flexible circuit board, or other appropriate substrate. In various embodiments of the present invention, the daughter, riser, or other board, card, or device may be a memory card, audio card, central processing unit or other processor card, graphics card, wired or wireless networking card, memory device, or other type of board, card, or device. The printed circuit board, flexible circuit board, or other appropriate substrate may be a main-logic board, motherboard, or other board.

An illustrative embodiment of the present invention may provide a connector having a housing with a slot forming an opening in a top side. The slot and opening may be arranged to receive a daughter, riser, or other card, board, or device. This connector may provide a high density of contacts by arranging contacting portions of contacts in multiple rows in the slot. Tail portions of the contacts may emerge from a bottom of the housing. The tail portions may be through-hole, surface-mount, or other type of contacting portion, or combination thereof. The tail portions may be soldered or otherwise fixed to a printed circuit board, flexible circuit board, or other appropriate substrate.

Another illustrative embodiment of the present invention may provide a connector having a slot forming an opening in a top of a housing. The slot may accept or receive an edge of a daughter or riser card. Contacting portions of contact pins in the connector housing may be arranged to mate with surface contacts near the edge of the daughter card. To improve high-speed performance, these contacting portions and corresponding surface contacts may be arranged in various patterns to provide shielding for signals, such as differential pair signals.

In one example, contacting portions and surface contacts may be arranged in two or more rows, and these rows may be at least approximately aligned, or they may be offset. Where contacts in these rows may be aligned, a first contact in a first row may be aligned with a second contact in a second row. These contacts may have a ground contact on each side, where the ground contact runs the length of both contacts and the space between them. This configuration may be used to carry differential signals. Where contacts are offset, two adjacent contacts may be used to carry a differential signal. These adjacent contacts may have a ground contact on each side, and a third ground contact below (or above). By positioning ground contacts in these ways, differential pair signals may be shielded to reduce cross-talk and to improve signal quality. To further improve signal quality, the ground contacts may include one or more contacting points to form electrical connections to a shield around a housing of the connector. Air gaps may be placed between contacts to reduce pin-to-pin capacitive coupling.

Embodiments of the present invention may improve high-speed performance by shielding signals as described above. Further shielding, for example, by providing a conductive shield around the housing, may further improve high-speed performance. Again, further shielding may be provided by embodiments of the present invention where ground contacts have one or more contacting portions forming electrical connections with a shield. In other embodiments of the present invention, shielding is omitted to prevent coupling through the shield between signal lines. In these embodiments, a nonconductive frame or shell may be placed around a housing of the connector. In a specific embodiment of the present invention, the nonconductive frame or shell is stretched before being placed over the housing for increased mechanical durability. The nonconductive frame or shell may be placed over the housing during manufacturing before reflow, or after reflow so that the nonconductive frame or shell may avoid the intense heat of this manufacturing step.

Another embodiment of the present invention may provide improved high-speed performance by simplifying an interconnect between a daughter or riser board and a main-logic board. In one specific embodiment of the present invention, a single contact may be used to convey a signal from a surface contact on a card or board to a surface contact on a main-logic board. This interconnect may reduce a number of contact points that may otherwise be needed, thus reducing the impendence and reactance of the interconnect path and improving high-speed performance.

Another embodiment of the present invention may provide a robust connector by including one or more barbs extending from the contacts, where the one or more barbs are inserted into a housing of the connector. These barbs may each include one or more teeth that may be used to secure the barb in place. These teeth may help to reduce or prevent movement of the contact in the housing that may otherwise occur due to forces placed on the contact by a card inserted into the connector. Durability of these connectors may be further enhanced by embodiments of the present invention, where one or more metal pins are used to provide mechanical support for a housing. These pins may be spot or laser welded or otherwise fixed to a shield. The pins may extend through the housing and emerge from a bottom of the connector, where they may be inserted into openings or make contact with contacts of a printed circuit board or other appropriate substrate. The pins may also be soldered to traces around the openings, or to contacts on a surface of the printed circuit board. Similarly, a key may be made of metal or other durable material in embodiments of the present invention to prevent damage to the connector or card by improper insertion of a card.

Another embodiment of the present invention may provide a method of manufacturing a robust connector. This method may include receiving a housing having central passage to accept a card, the central passage having a first side and a second side. The housing may further have a first outside side and a second outside side. A first plurality of contacts may be inserted into slots in the first outside side and the second outside side of the housing. Some or all of the first plurality of contacts may include one or more barbs that may extend into the housing. The barbs may include one or more teeth along a top or bottom edge, or along both edges, of the barb. A second plurality of contacts may be inserted into slots in the first side and the second side of the central passage. The second plurality of contacts may include contacts of a first type and a second type, where a difference between the types is a position of a contact tail. Where these contact tails are through-hole contact tails, varying the type of contact, and therefore the position of the contact tail, may space the through-hole contacts apart from each other. This may aid in construction of a printed circuit board on which the connector may reside.

This method may further include inserting side panels over the first outside side and the second outside side of the housing. These side panels may be insulative to isolate the first plurality of contacts from a shield and from each other. Dovetailed notches in the housing may be used to help secure the side panels in place. Metal pins may be inserted through the housing. A shell or shield may be placed over the housing and spot or laser welded, or otherwise fixed, to the metal pins. The shell or shield may be conductive or nonconductive.

Another embodiment of the present invention may route traces to provide shielding on a daughter or riser board or card. These techniques may also be applied to routing traces on main-logic boards. In a specific embodiment, traces on a card that are connected to contacts for a differential pair may be routed under a ground pad on the card. The ground pad may be further connected to ground on other layers of a printed circuit board of the daughter or riser card. Such grounding may provide shielding, improve signal quality, and decrease crosstalk.

Another embodiment of the present invention may provide a connector having a high-density of contacts. This embodiment may provide a high density of contacts by providing multiple rows of contacts on each side of an opening arranged to receive a card. Density may be further increased by close spacing of contacts that is achieved by placing air-gaps between contacts to reduce coupling. Density may also be improved by using side panels and a shell or shield to secure contacts in place. Barbs on some contacts may be used to further secure contacts. Mechanical stability may be improved by the use of pins and one or more keying features located in a housing of the connector. A use of a mix of through-hole and surface-mount contacts may be used to enable the routing of signals away from the connector and may help to improve the ability of the connector to be mounted on a printed circuit board or other substrate.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1B:
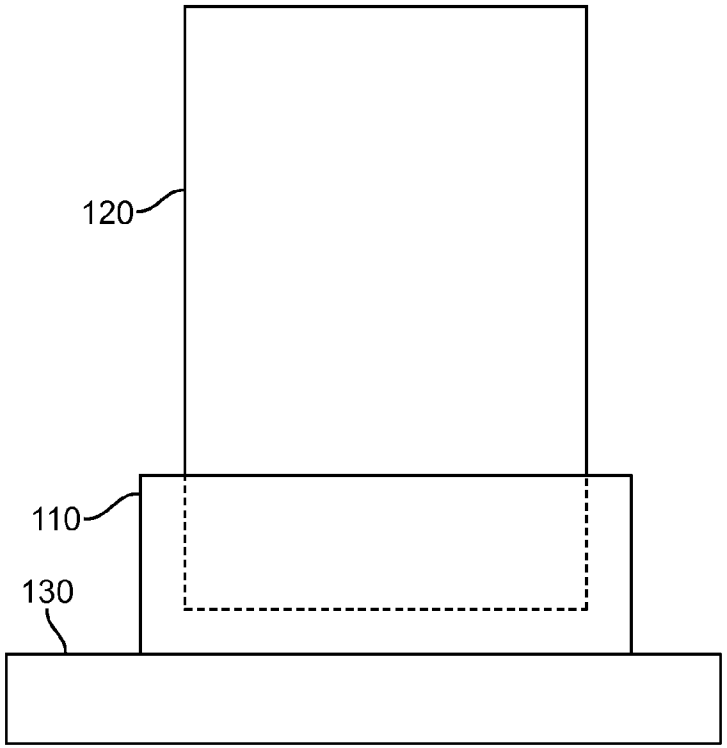
FIGS. 1A and 1B illustrate a portion of an electronic device according to an embodiment of the present invention.
Figure 1A:
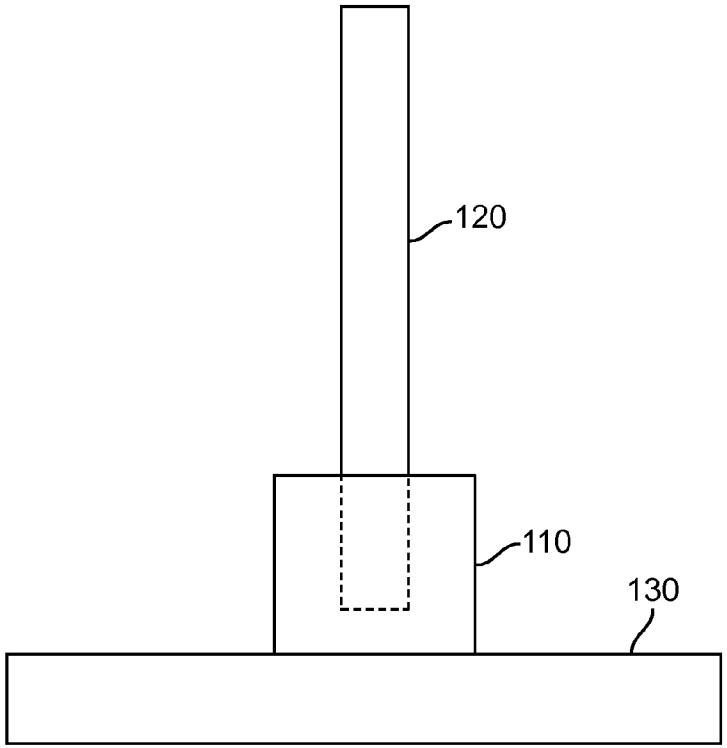

FIGS. 1A and 1B illustrate a portion of an electronic device according to an embodiment of the present invention. This figure, as with the other included figures, is shown for illustrative purposes and does not limit either the possible embodiments of the present invention or the claims.

FIG. 1A illustrates a side view of connector 110, daughter or riser card 120, and main-logic board 130. Connector 110 may include a housing having a slot forming an opening in the top of the housing. This slot and opening may receive card 120. Connector 110 may be soldered or otherwise fixed to main-logic board 130.

In various embodiments of the present invention, daughter or riser card 120 may be a memory card, audio card, central processing unit or other processor card, graphics card, wired or wireless networking card, memory device, or other type of board, card, or device. Main-logic board 130 may be a printed circuit board, flexible circuit board, or other appropriate substrate. While in this example, connector 110 is shown as providing an orthogonal connection between card 120 and main-logic board 130, in other embodiments of the present invention, card 120 and main-logic board 130 may be parallel or have other orientations.

FIG. 1B illustrates a side view of connector 110, card 120, and main-logic board 130. In various embodiments of the present invention, connector 110 may save space on main-logic board 130. Specifically, connector 110 may have a reduced footprint. Embodiments of the present invention may reduce this footprint by providing multiple rows of contacts on one or more sides of a slot in connector 110. By providing multiple rows of contacts, the contact density in connector 110 may be increased. This increase in density may also allow for the use of narrower cards 120.

Embodiments of the present invention may also provide an improved high-speed performance. This may be done by simplifying interconnect between card 120 and main-logic board 130. High-speed performance may also be improved through improved arrangements of contacts in connector 110. Examples are shown in the following figures.

Figure 2:
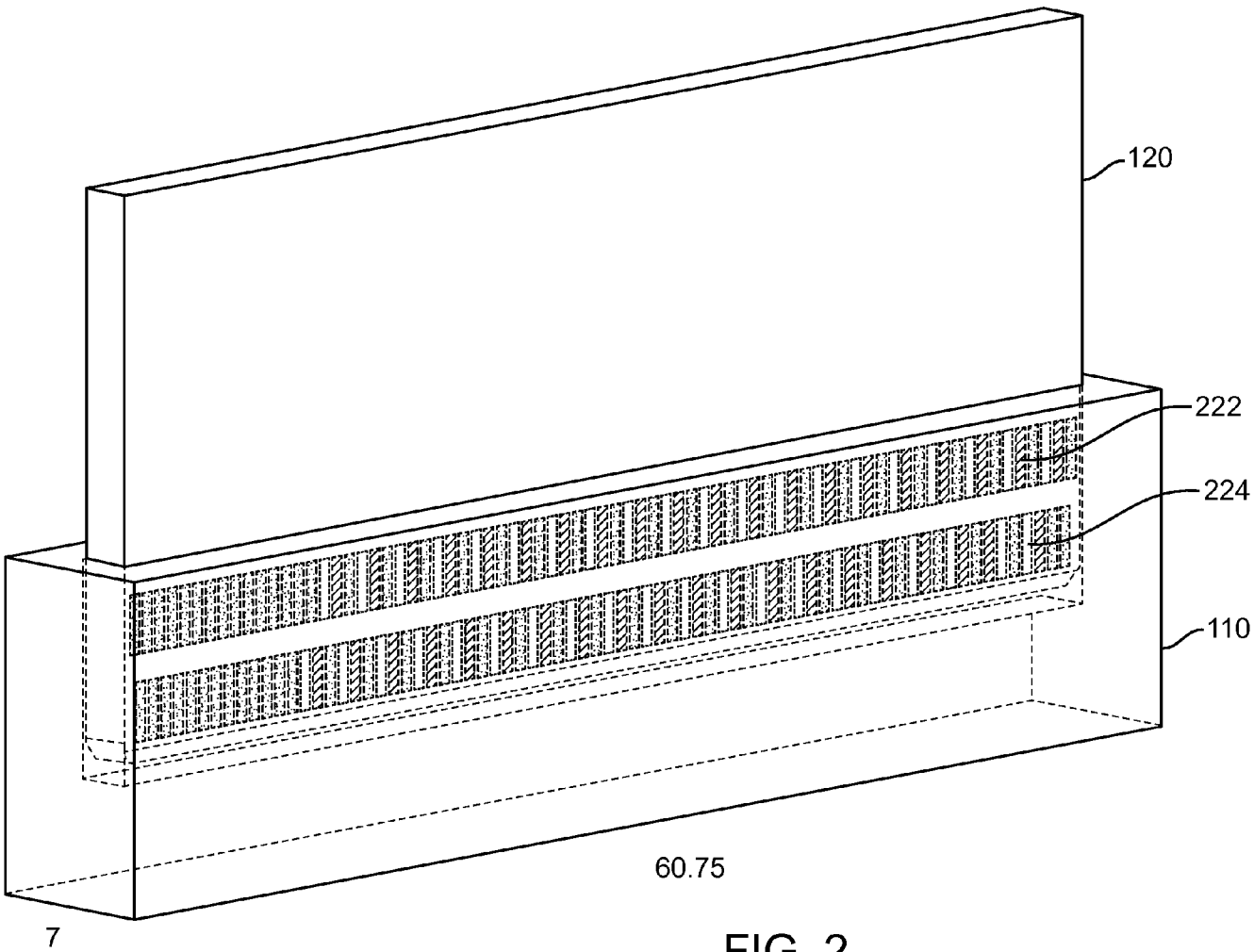
FIG. 2 illustrates a simplified cut-away view of a connector according to an embodiment of the present invention.

FIG. 2 illustrates a simplified cut-away view of a connector according to an embodiment of the present invention. In this example, connector 110 is shown accepting card 120. A bottom side of connector 110 may be mated to a main-logic board or other appropriate substrate. In this example, card 120 may include two rows of contacts 222 and 224. In other embodiments of the present invention, card 120 may include three or more rows of contacts. These contacts may be surface contacts. That is, they may be formed by plating conductive material on a surface of card 120. Connector 110 may have corresponding contact pins having contacting portions arranged to mate with surface contacts on card 120. A back side of card 120 may have a similar pattern of contacts, which may mate with corresponding contacts in connector 110. Contacts in rows 222 and 224 may be arranged in various ways. Specifically, they may be arranged to provide improved high-speed performance. For example, they may be arranged to provide shielding for differential pairs of signals. An example is shown in the following figure.

Figure 3:
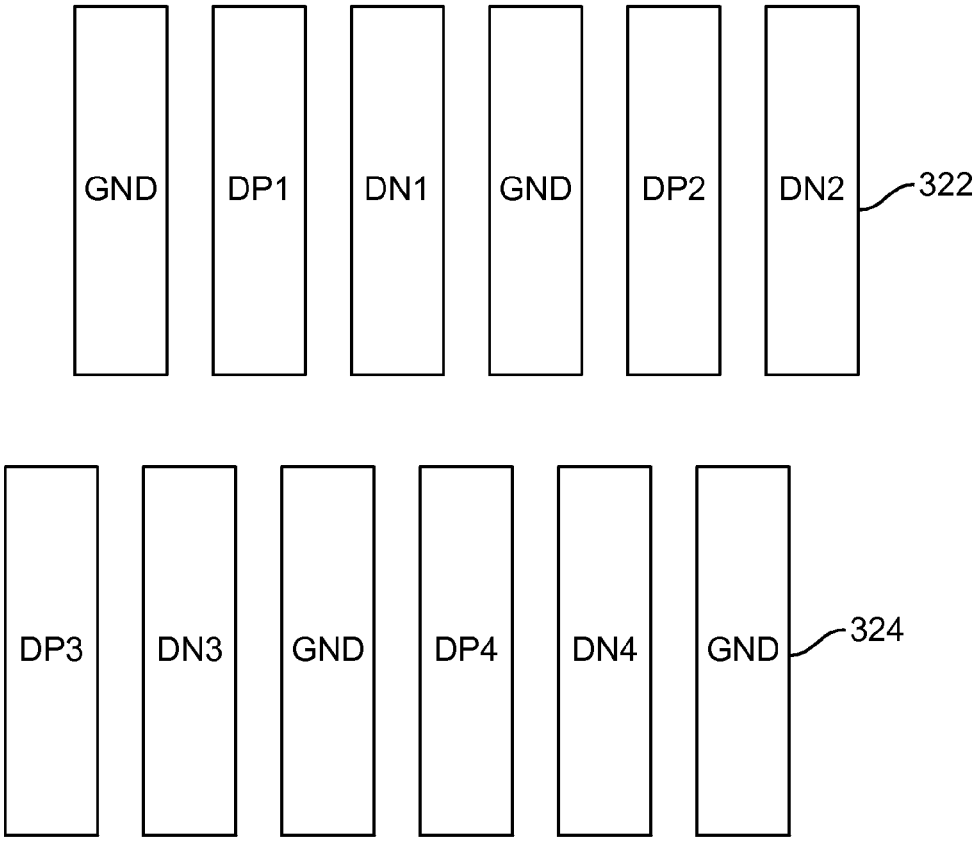
FIG. 3 illustrates portions of two rows of contacts arranged according to an embodiment of the present invention.

FIG. 3 illustrates portions of two rows of contacts arranged according to an embodiment of the present invention. In this example, the portions of two rows of contacts 322 and 324 are offset from each other. A differential pair of contacts, DP1 and DN1, may have ground contacts on either side. This differential pair further may have a ground contact below it. This arrangement may provide ground isolation from differential pairs DP1 and DN1 to differential pairs DP2 and DN2, DP3 and DN3, and DP4 and DN4. This ground isolation may improve signal quality on the differential pair lines, and it may reduce cross talk. This may, in turn, provide improved high-speed performance.

While the various ground contacts shown herein may be connected to ground, in various embodiments of the present invention they may be connected to other low-impedance paths, or AC grounds. For example, they may be connected to a power supply, bias line, control signal, or other appropriate line.

Figure 4:
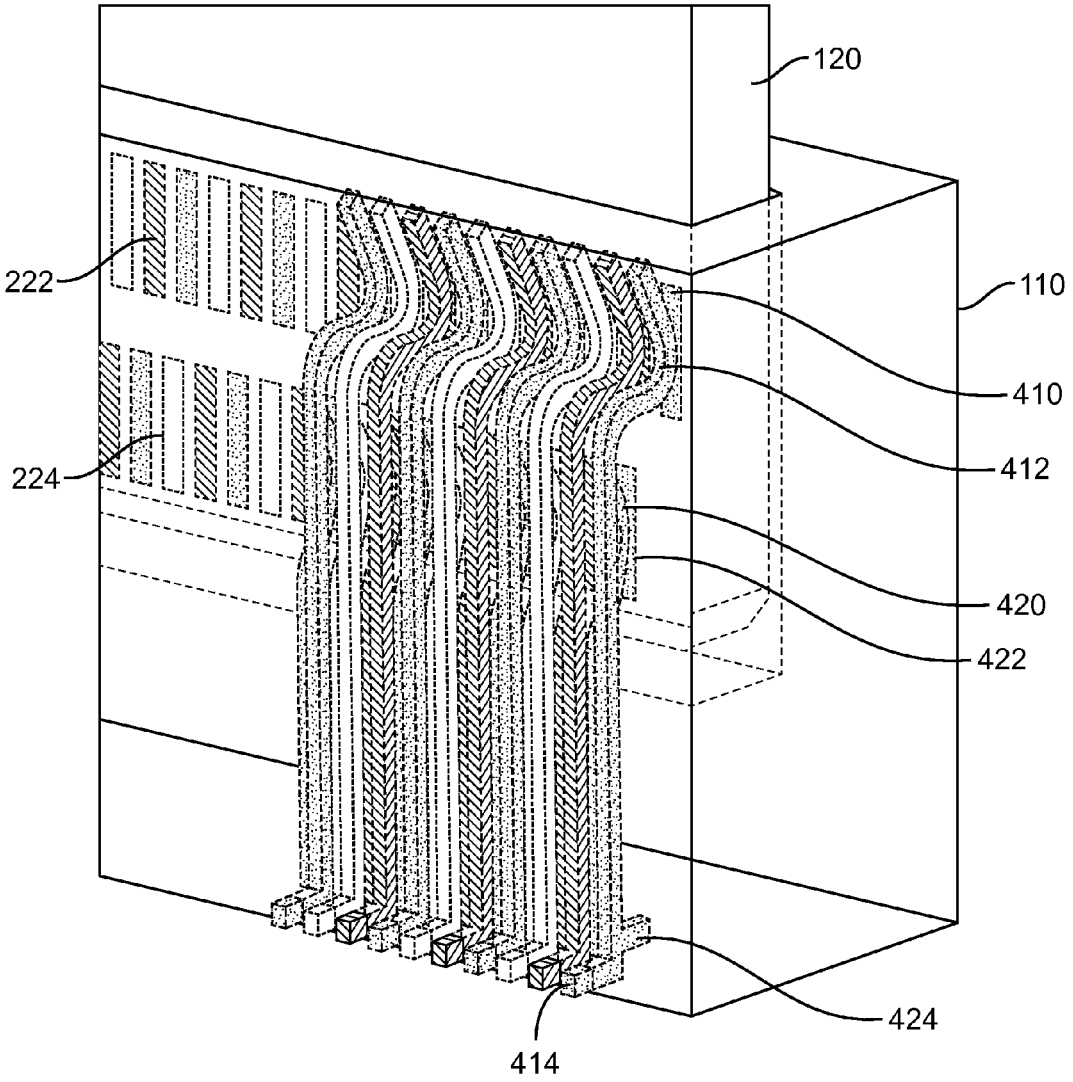
FIG. 4 illustrates a cut-away view of a portion of a connector according to an embodiment of the present invention.

FIG. 4 illustrates a cut-away view of a portion of a connector according to an embodiment of the present invention. In this example, connector 110 may include a first row of contact pins 410 and a second row of contact pins 420. Contact pins 410 and 420 may improve high-speed performance by providing simplified interconnections between card 120 and a main-logic board or other substrate (not shown). For example, contacts 410 may provide a simple and direct path from a surface contact 222 on card 120 to a contact (not shown) on a main-logic board (not shown).

In various embodiments of the present invention, contact pins in connector 110 may have various shapes. Examples are shown in the following figures.

Figure 5A:
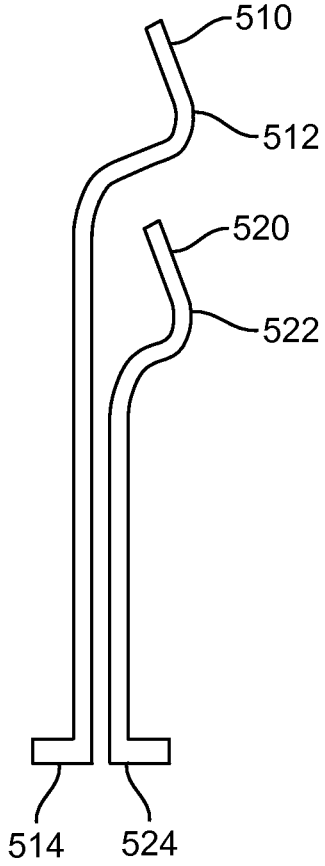
FIGS. 5A and 5B illustrate side views of contact pins that may be used in connectors according to embodiments of the present invention.
Figure 5B:
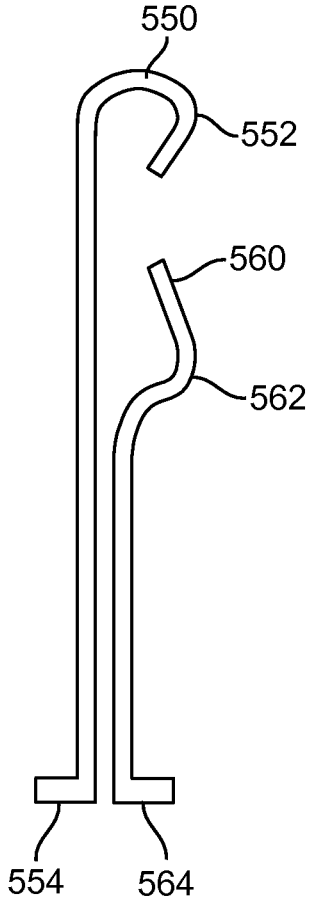

FIGS. 5A and 5B illustrate side views of contact pins that may be used in connectors according to embodiments of the present invention. Contact 510 may include contacting portion 512 and tail portion 514. Contacting portion 512 may form electrical connections with surface contact 222 on card 120. Tail portion 514 may contact surface contacts (not shown) on a main-logic board or other substrate (not shown).

Contact 520 may include contacting portion 522 and tail portion 524. Contacting portion 522 may form electrical connections with surface contact 224 on card 120. Tail portion 524 may contact a surface contact (not shown) on a main-logic board or other substrate (not shown). In other embodiments of the present invention, one or more of these contacts may have through-hole tail portions. For example, contact 510, which may be located at an edge of the housing, may have surface-mount tail portion 514, while interior contact 520 may have through-hole tail portion 524. This arrangement may facilitate inspection of a finished device by having surface-mount contacts visible at an edge of the housing and through-hole contacts under the housing where they would otherwise not be visible. In still other embodiments of the present invention, the interior contact 520 may have a tail portion 524 extending into a central opening in the housing where it may be inspected. Contacts 550 and 560 may be similarly arranged to have contacting portions 552 and 562, as well as surface-mount tail or contacting portions 554 and 564.

In various embodiments of the present invention, one or more contacts in connector 110 may have different width. For example, a power or ground contact in connector 110 may have a wide width to handle large currents, or to provide increased isolation between adjacent pins on each of its sides. These wider connector contacts may have correspondingly wide surface contacts on a card 120 and main-logic board 130.

While in these examples, tail portions are shown as surface-mount portions, other types of tail portions, such as through-hole portions, may be used consistent with embodiments of the present invention.

Again, these contacts may be arranged in ways to improve signal performance. Signal performance and shielding may be further improved by employing ground tabs in connector 110 below card 120. An example is shown in the following figure.

Figure 6:
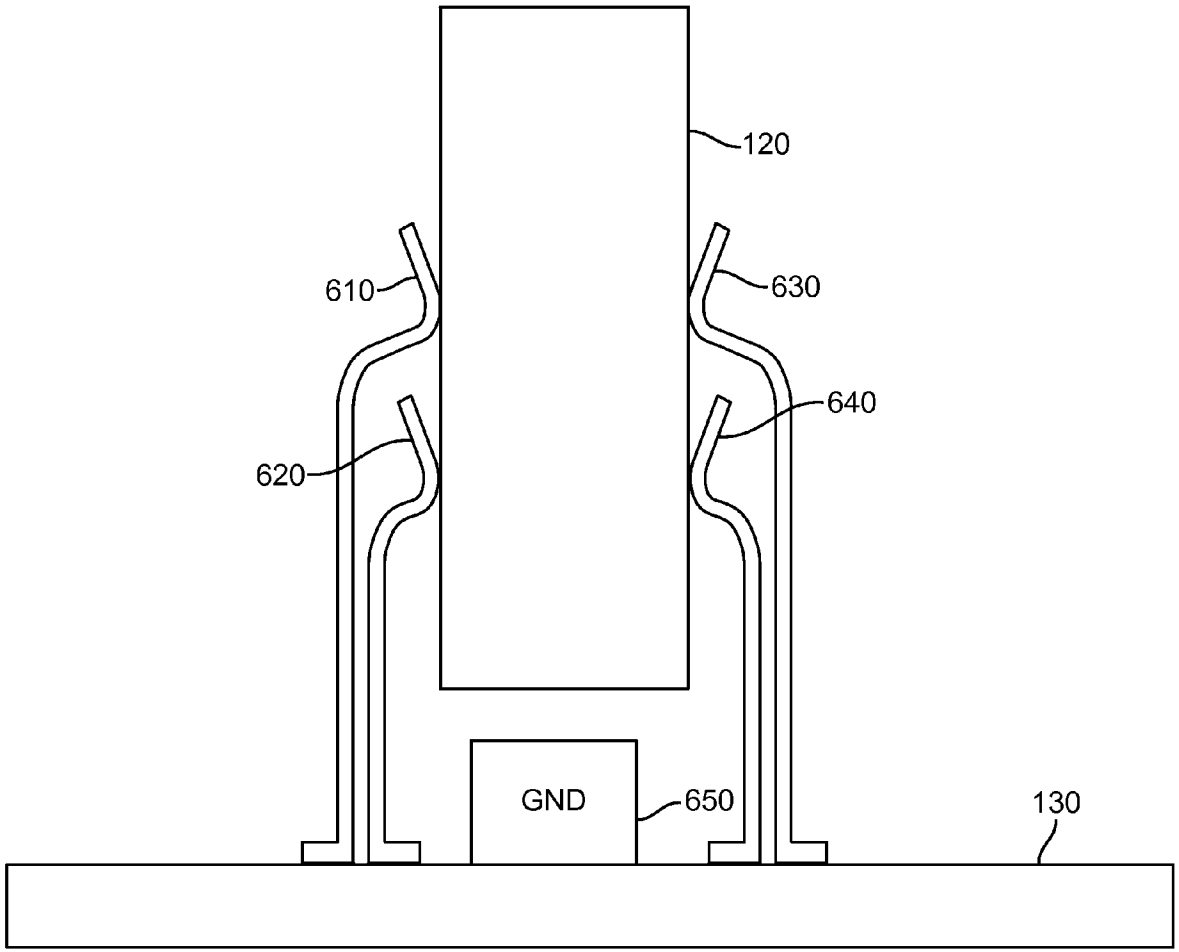
FIG. 6 illustrates a side view of a cut-away portion of a connector according to an embodiment of the present invention.

FIG. 6 illustrates a side view of a cut-away portion of a connector according to an embodiment of the present invention. In this example, contacts 610, 620, 630, and 640 may provide electrical connections between card 120 and main-logic board 130. Ground tab 650 may be placed under daughter card 120 between the contacts. This ground tab may have surface-mount or through-hole contacting portions connected to corresponding contacts in main-logic board 130.

Again, surface contacts on a card and corresponding contacts in a connector may be arranged in various ways consistent with embodiments of the present invention. Another example is shown in the following figure.

Figure 7:
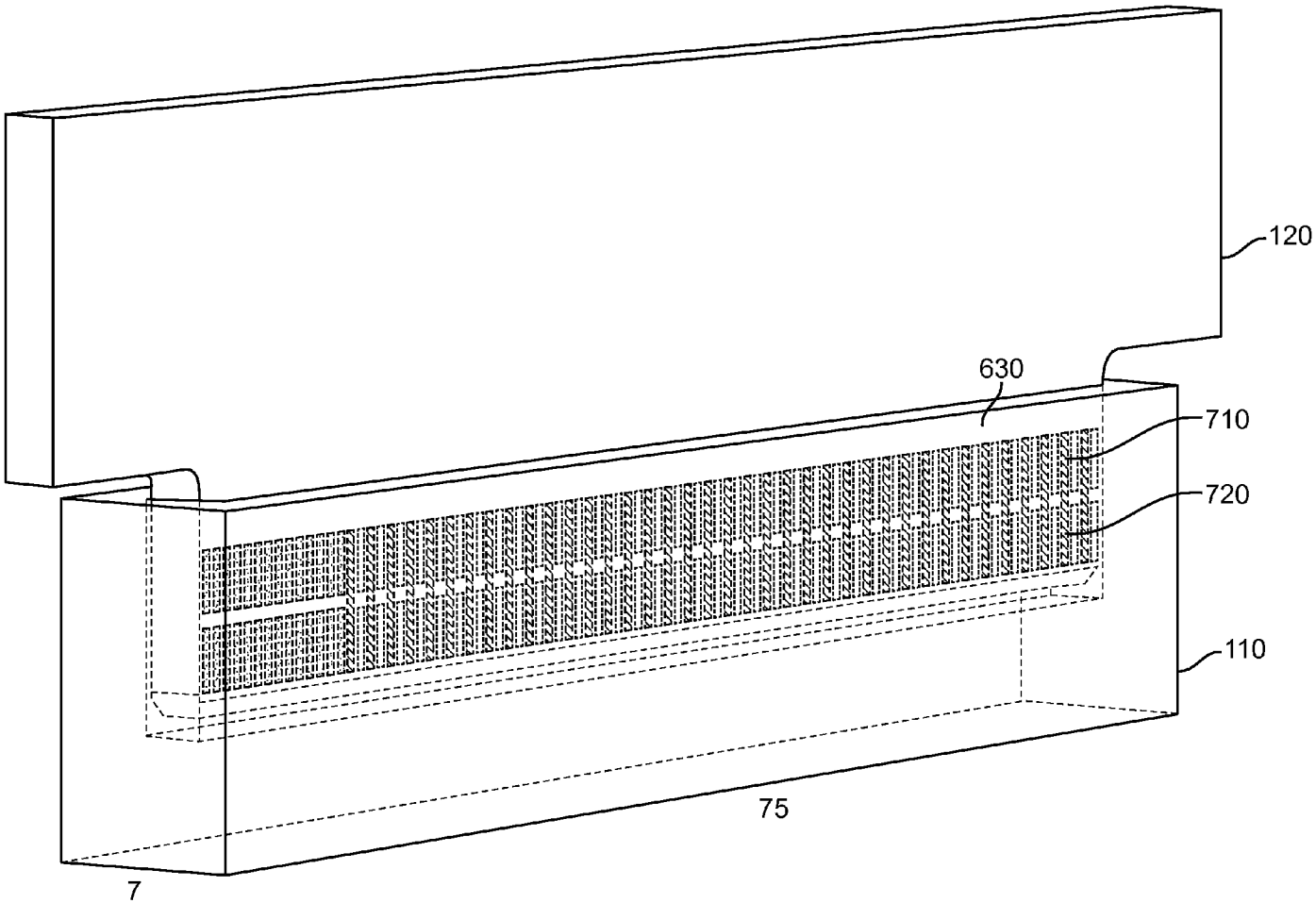
FIG. 7 illustrates a cut-away view of a connector according to an embodiment of the present invention.

FIG. 7 illustrates a cut-away view of a connector according to an embodiment of the present invention. Connector 110 may accept an edge of card 120. Card 120 may include two rows of contacts 710 and 720. These contacts may include differential pairs of contacts, where one contact in the differential pair is located above the other. These pairs of contacts may be isolated by ground contacts that run the length of both contacts in the differential pair as well as the space between the two contacts. An example is shown in the following figure.

Figure 8:
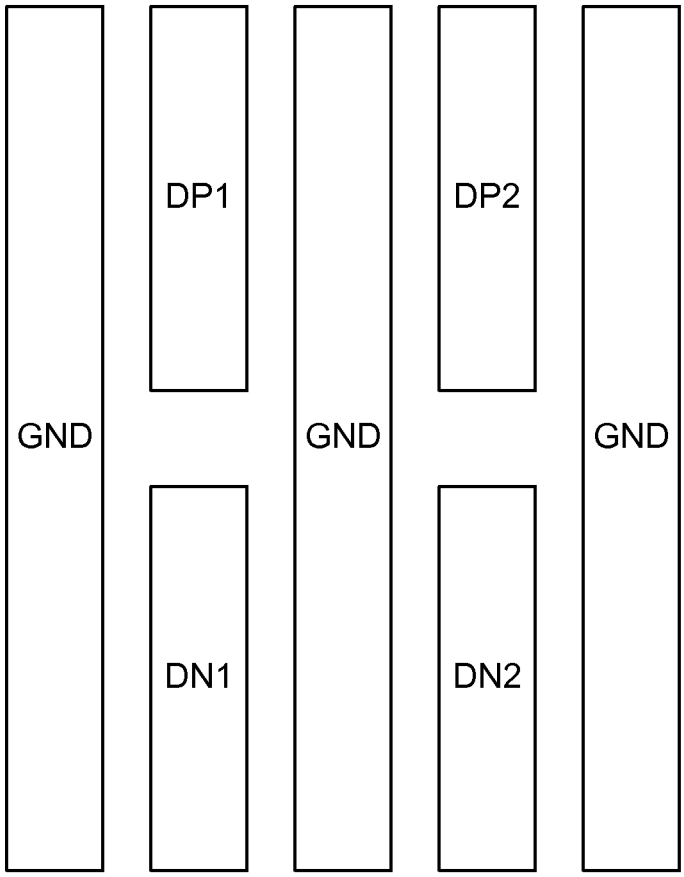
FIG. 8 illustrates the arrangement of contacts for two differential pairs according to an embodiment of the present invention.

FIG. 8 illustrates the arrangement of contacts for two differential pairs, DP1 and DN1 and DP2 and DN2, according to an embodiment of the present invention. These differential pairs are isolated by ground contacts that may substantially run the length of the differential pair contacts and the space between them. Since only one contact pin in connector 110 is needed for these ground contacts, it may have a different shape or profile as compared to the signal contacts shown earlier. An example is shown in the following figure.

Figure 9:
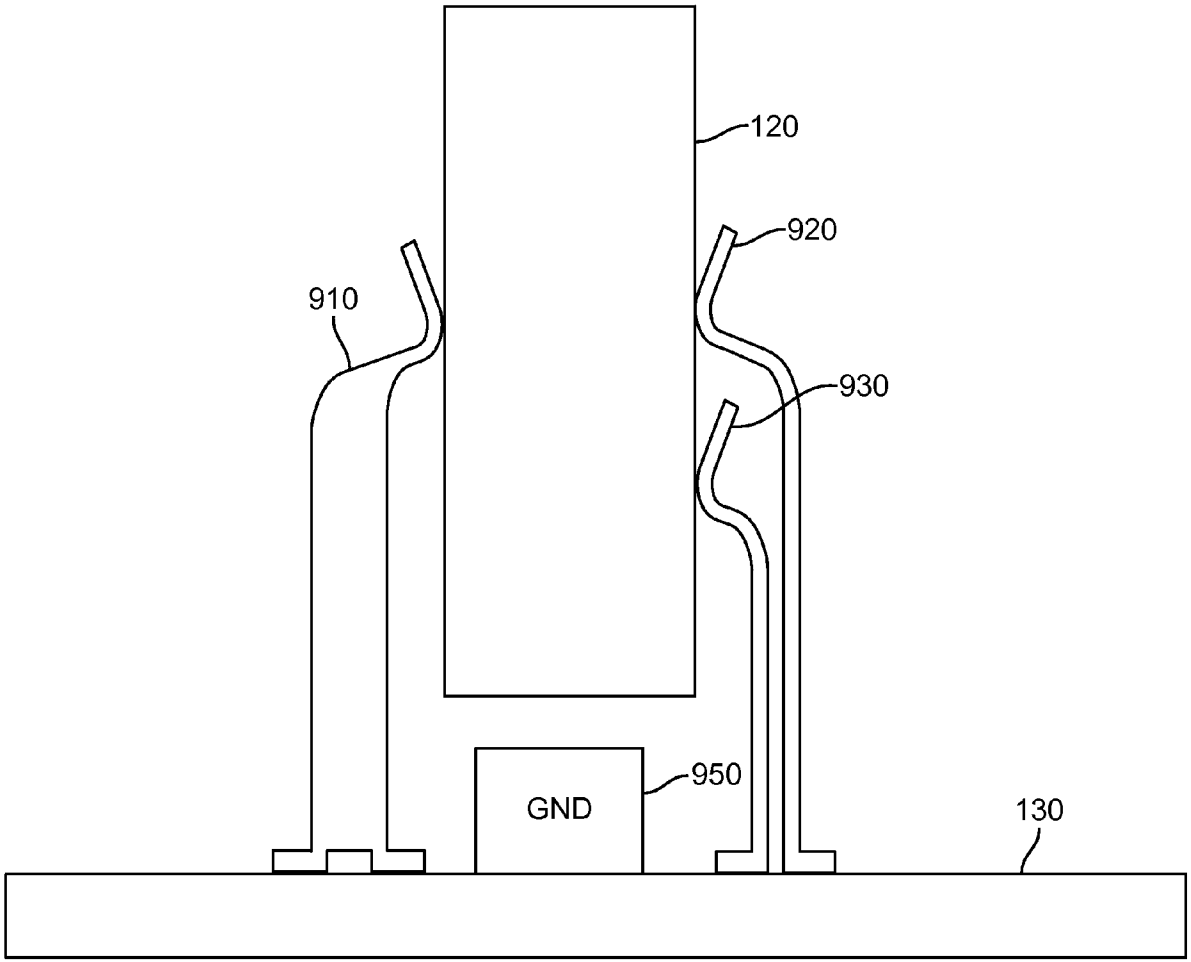
FIG. 9 illustrates a cut-away side view of a portion of a connector according to an embodiment of the present invention.

FIG. 9 illustrates a cut-away side view of a portion of a connector according to an embodiment of the present invention. In this example, contacts 910, 920, and 930 electrically connect contacts on card 120 to contacts on main-logic board 130. In this example, contact 910 may be a ground contact, while contacts 920 and 930 may be signal contacts for differential pair. Ground contact 910 may be made wider, as shown, to provide reduced impedance in the ground line. Ground tabs 950 may be included as before. Ground tabs 950 may optionally be merged into a single structure with contact 910.

Again, embodiments of the present invention may provide a high degree of ground shielding and crosstalk isolation. For example, as shown in FIGS. 3 and 8, shielding and isolation may be enhanced through arrangement of signal and ground contacts on a daughter or riser board. This shielding may further be improved by routing signals on the card in a manner consistent with an embodiment of the present invention. These techniques may also be applied to routing signals on a main logic board. An example is shown in the following figure.

Figure 10:
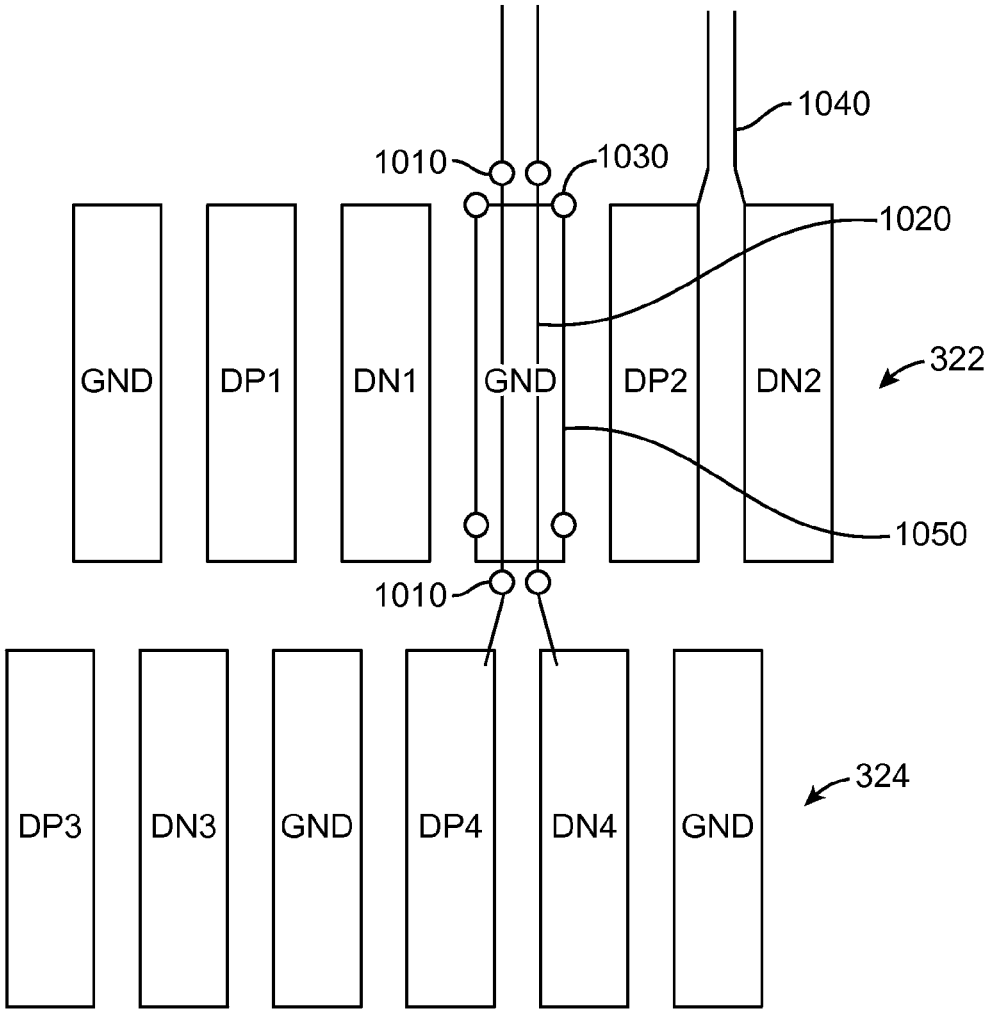
FIG. 10 illustrates a method of routing signals to provide shielding for signals on a daughter or riser card according to an embodiment of the present invention.

FIG. 10 illustrates a method of routing signals to provide shielding for signals on a daughter or riser card according to an embodiment of the present invention. In this example, signals traces 1020 couple to pads for differential pair DP4 and DN4. These traces may reach first vias 1010 and change layers on daughter or riser card 120. Vias 1010, and the other vias shown here, may be micro-vias that drop one or more layers into the printed circuit board of the daughter or rise card 120. Traces 1020 may then proceed underneath ground pad 1050. Once they have passed underneath ground pad 1050, traces 1020 may emerge through a second set of vias 1010.

In some embodiments of the present invention, the impedance (Zo) requirements are such that the ground plane under contacts for differential pair DP4 and DN4 should be removed. Since the ground plane does not shield the surface from inner route layers, the signal traces 1020 may be routed beneath ground pad 1050. In this way, traces 1020 are at least partially shielded by ground pad 1050. This shielding may be further enhanced by connecting ground pad 1050 to grounds on one or more other layers through vias 1030. By burying traces 1020 beneath ground pad 1050, cross talk and isolation to differential pairs DP1 and DN1, and DP2 and DN2, which are routed on traces 1040, may be improved.

To further improve signal quality, stub portions of vias 1010 may be avoided. Specifically, printed circuit boards may be manufactured where vias, such as vias 1010, traverse through all layers of the board. These multilayer vias are then connected to traces on intermediate layers, thereby leaving stubs above or below the traces on these intermediate levels. These stubs may emit radio-frequency interference, degrading the signal and increasing crosstalk. Accordingly, embodiments of the present invention may route signals such that they change layers through vias which begin and terminate on the individual layers where traces 1020 are routed.

Again, contacts in various embodiments of the present invention may have various shapes. Further examples are shown in the figures below.

Figure 11:
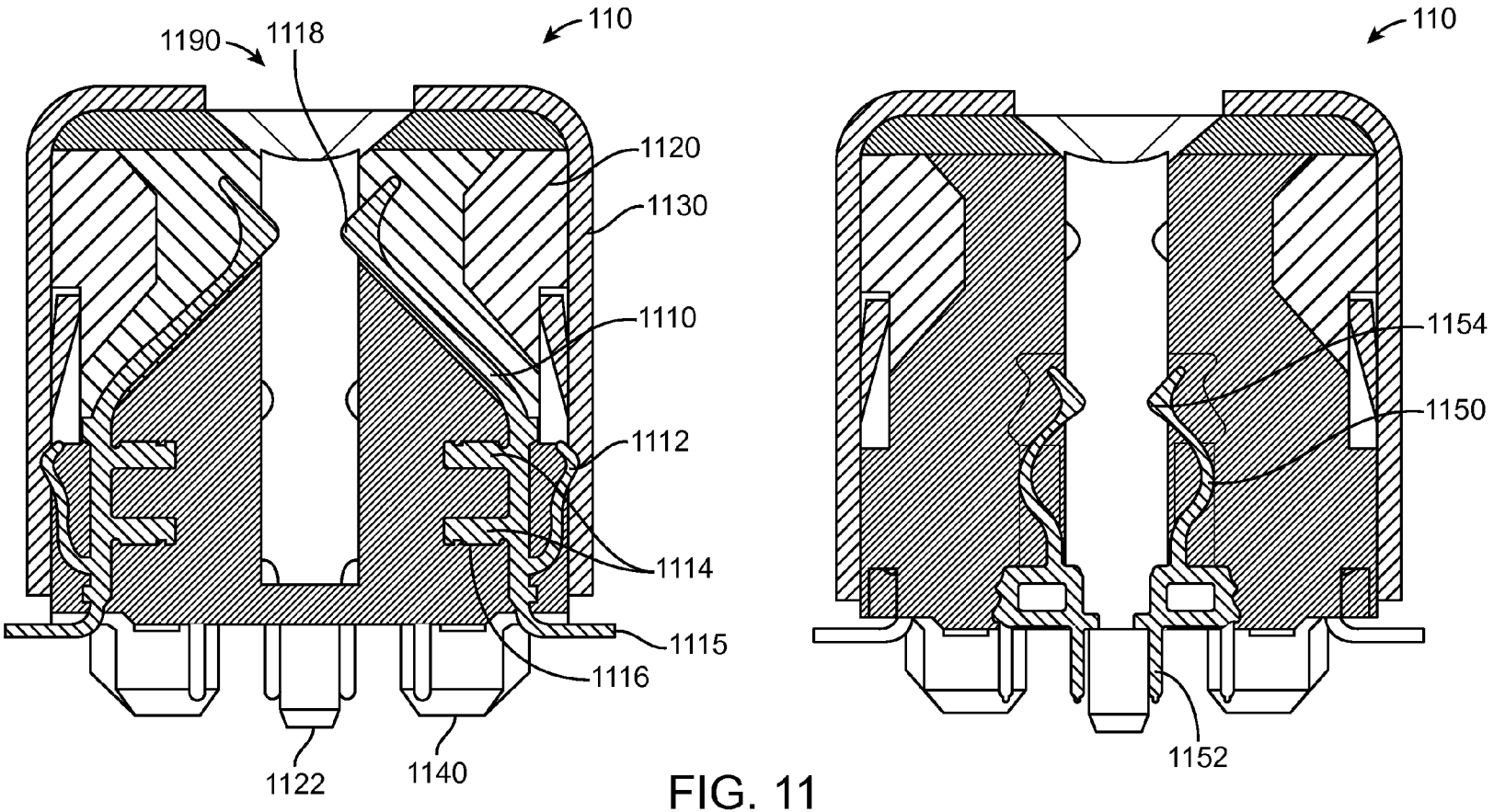
FIG. 11 illustrates cutaway views of a connector according to an embodiment of the present invention.

FIG. 11 illustrates cutaway views of a connector according to an embodiment of the present invention. This connector may include central passage 1190 to accept a card. Connector 110 may include contacts 1110 and 1150, which may be supported by housing 1120. Housing 1120 may be at least partially surrounded by shield 1130. Housing 1120 may include one or more posts 1122, which may be inserted into openings in a printed circuit board for mechanical stability. One or more metal pins 1140 may also be included for mechanical stability. Metal pins 1140 may also be inserted into openings in a printed circuit board. Metal pins 1140 may further be soldered to ground or other connections on a printed circuit board.

Contact 1110 may include contacting portion 1118 to mate (form an electrical connection) with a contact on a card (not shown.) Contact 1110 may also include contacting portion 1112, which may contact shield 1130, and surface-mount contact portion 1115.

One or more barbs 1114 may be included as part of contact 1110. These one or more barbs 1114 may be inserted into housing 1120 for mechanical stability. To provide further stability, one or more teeth 1116 may be provided along edges of barbs 1114. In a specific embodiment of the present invention, teeth 1116 may be located along a top edge of an upper barb 1114 and a lower edge of a lower barb 1114. When a card is inserted into central passage 1190, rotational stresses due to the force from the card on contact 1110 may have a tendency of driving teeth 1116 into housing 1120. This may further secure the position of contacts 1110 in housing 1120.

Contacts 1150 may include contacting portions 1152 to mate with corresponding contacts on a card (not shown.) Contacts 1150 may further include through-hole contacting portions 1152. Contacts 1150 may further include contacting portion 1154 to mate with a contact on a board inserted in central opening or passage 1190.

Again, power and ground contacts in connectors according to embodiments the present invention may be formed to have an additional width. This additional width may increase current carrying capabilities of the contacts. Also, the additional width may increase isolation between contacts on each side of the wider contact. An example is shown in the following figure.

Figure 12:
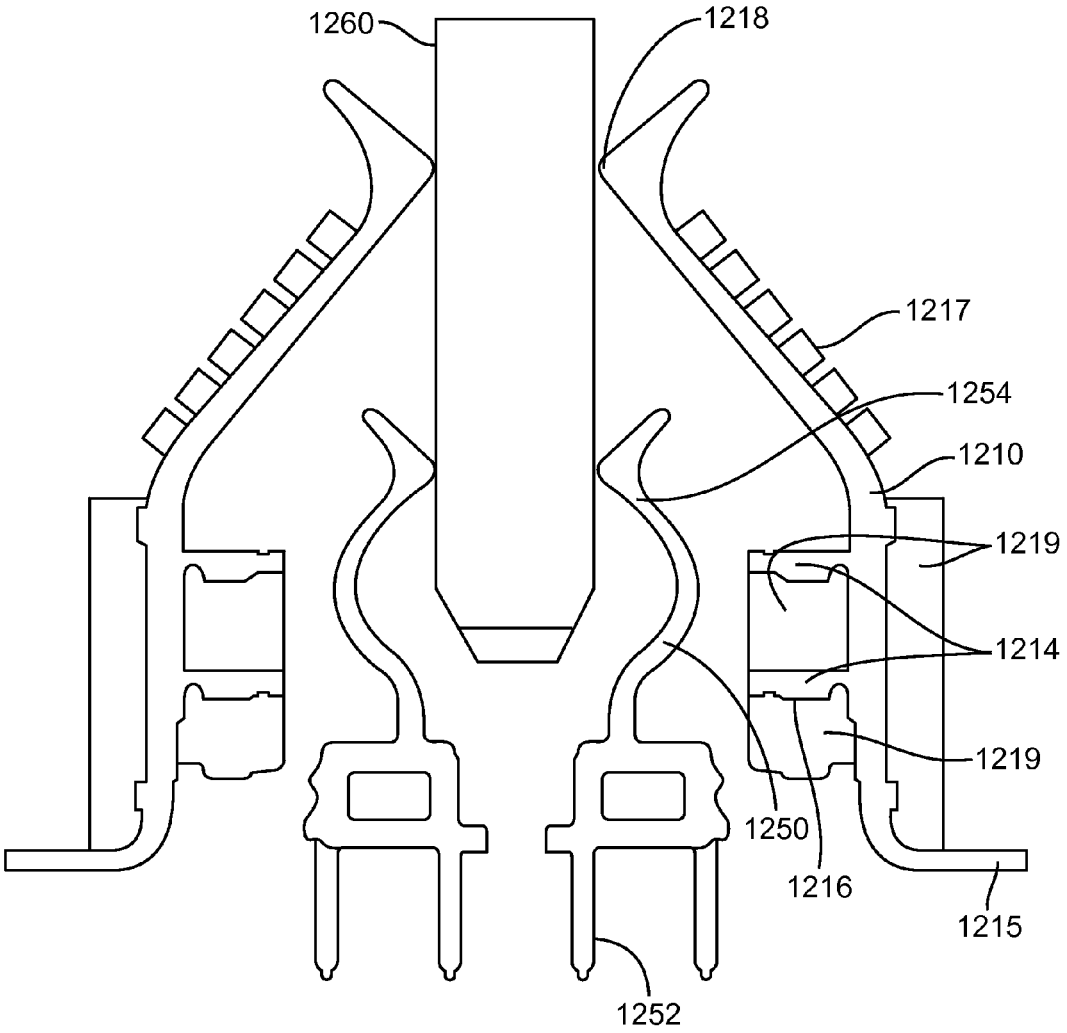
FIG. 12 illustrates contacts that may be used in connectors according to an embodiment of the present invention.

FIG. 12 illustrates contacts that may be used in connectors according to an embodiment of the present invention. This example includes contacts 1210 and 1250. Contacts 1210 may include a contacting portion 1218 to make contact to pad or contact area on card 1260 and surface-mount contact portion 1215. Contacts 1210 may further include wider portions 1219 and 1217 to improve current carrying capabilities and isolation. In particular, contacts such as contacts 1210 may be placed between signal pins where isolation between the signal pins is important. This may be the case where contacts 1210 are on each side of a pair of contacts carrying differential signals. Contacts 1210 may include barbs 1214 having teeth 1216. Contacts 1250 may include contacting portions 1254 and through-hole contact portion 1252.

Figure 13:
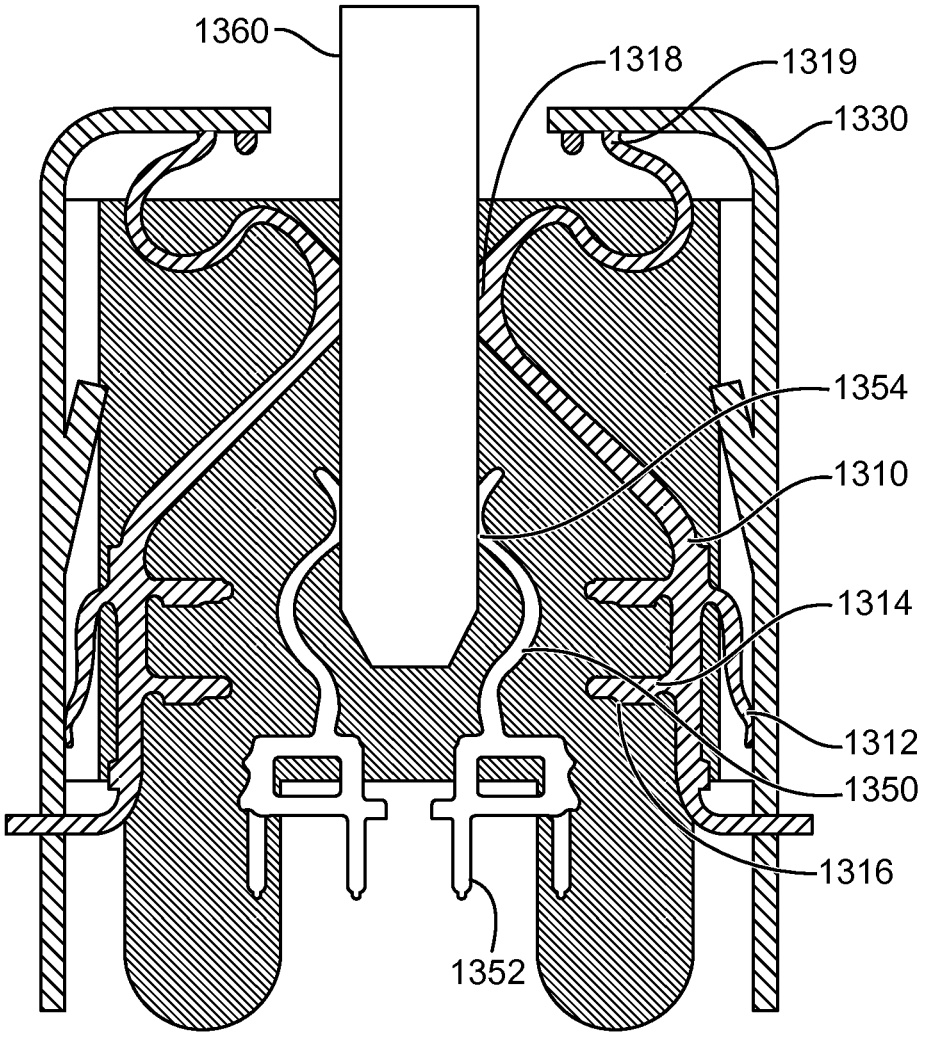
FIG. 13 illustrates other contacts that may be used in connectors according to an embodiment of the present invention.

FIG. 13 illustrates other contacts that may be used in connectors according to an embodiment of the present invention. These contacts include contacts 1310 and 1350. Contact 1310 may include contacting portions 1312 and 1319 to form electrical connections with shell 1330, and contacting portion 1318 to contact a contact on card 1360. Contact 1310 may include a serpentine portion between contacting portion 1318 and contacting portion 1319. This serpentine portion may help to ensure that contacting portion 1319 engages shield 1330 when a card 1360 is inserted. As before, contact 1310 may include a barbs 1314 having teeth 1316. Contacts 1350 may include contacting portion 1354 and through-hole portions 1352.

In the above examples, the barbs on the various contacts may extend horizontally into a housing of the connector. In this way, if various ones of the contacts are inserted into the housing at different depths, the surface-mount portions of the contacts may remain aligned. For example, in FIG. 11 above, if various contacts 1110 are inserted into housing 1120 to various depths, surface-mount contacting portions 1115 may remain aligned in a single plane. For this reason, in the above example, barbs 1114 are parallel to the surface-mount portions 1115. However, in other embodiments of the present invention, it may be desirable to angle one or more of these barbs to provide increased mechanical support. An example is shown in the following figure.

Figure 14:
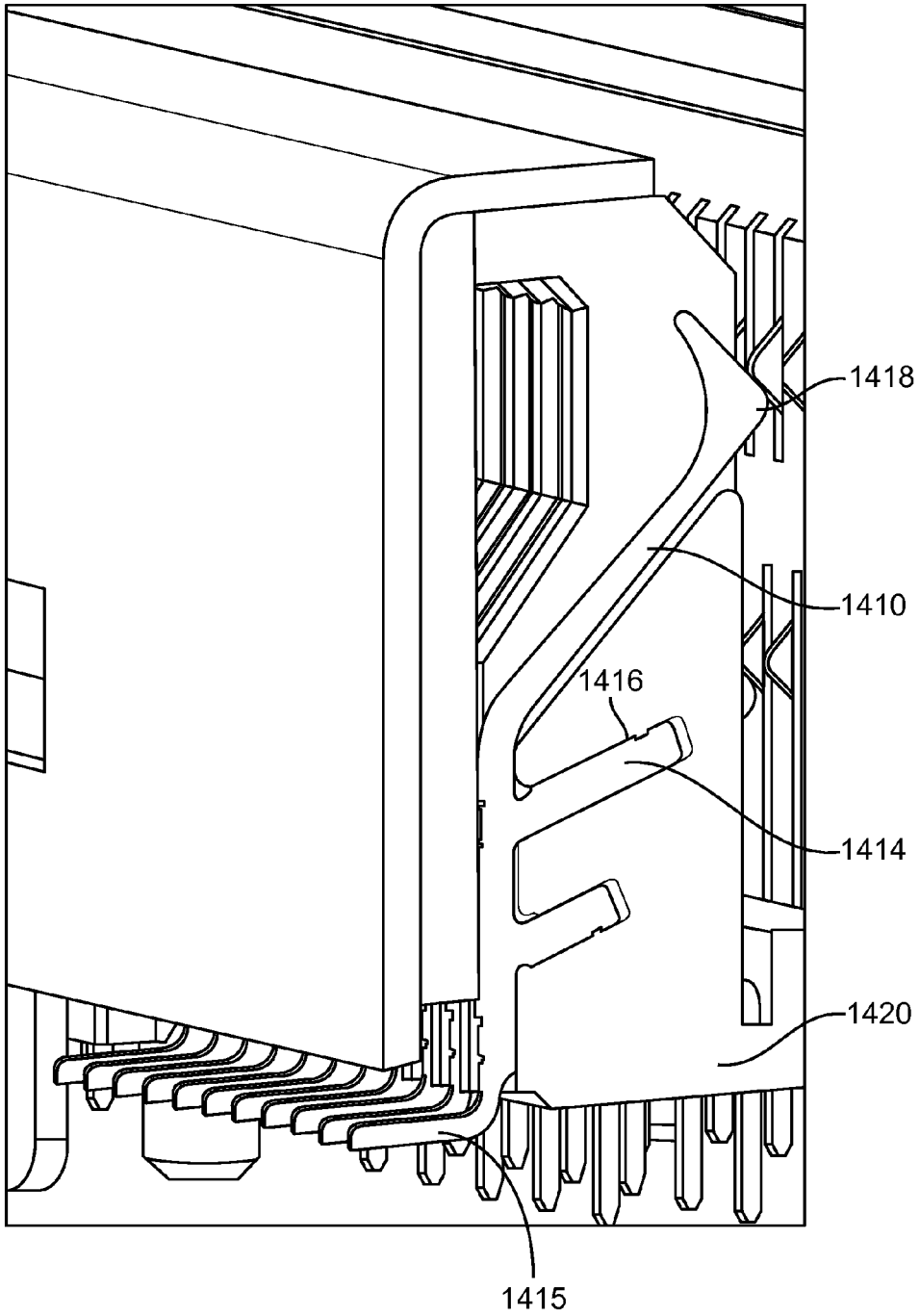
FIG. 14 illustrates a contact having angled barbs according to an embodiment of the present invention.

FIG. 14 illustrates a contact having angled barbs according to an embodiment of the present invention. In this example, contact 1410 includes contacting portion 1418 and barbs 1414. Barbs 1414 may include teeth 1416 as before. In this example, barbs 1414 may be angled into housing 1420. Again, as force is exerted on contact 1410 at contacting portion 1418, the teeth 1416 on barbs 1414 will engage housing 1420, thereby tending to reduce or prevent movement of contact 1410 relative to housing 1420. Contact 1410 may further include surface-mount contact portion 1415.

Figure 15:
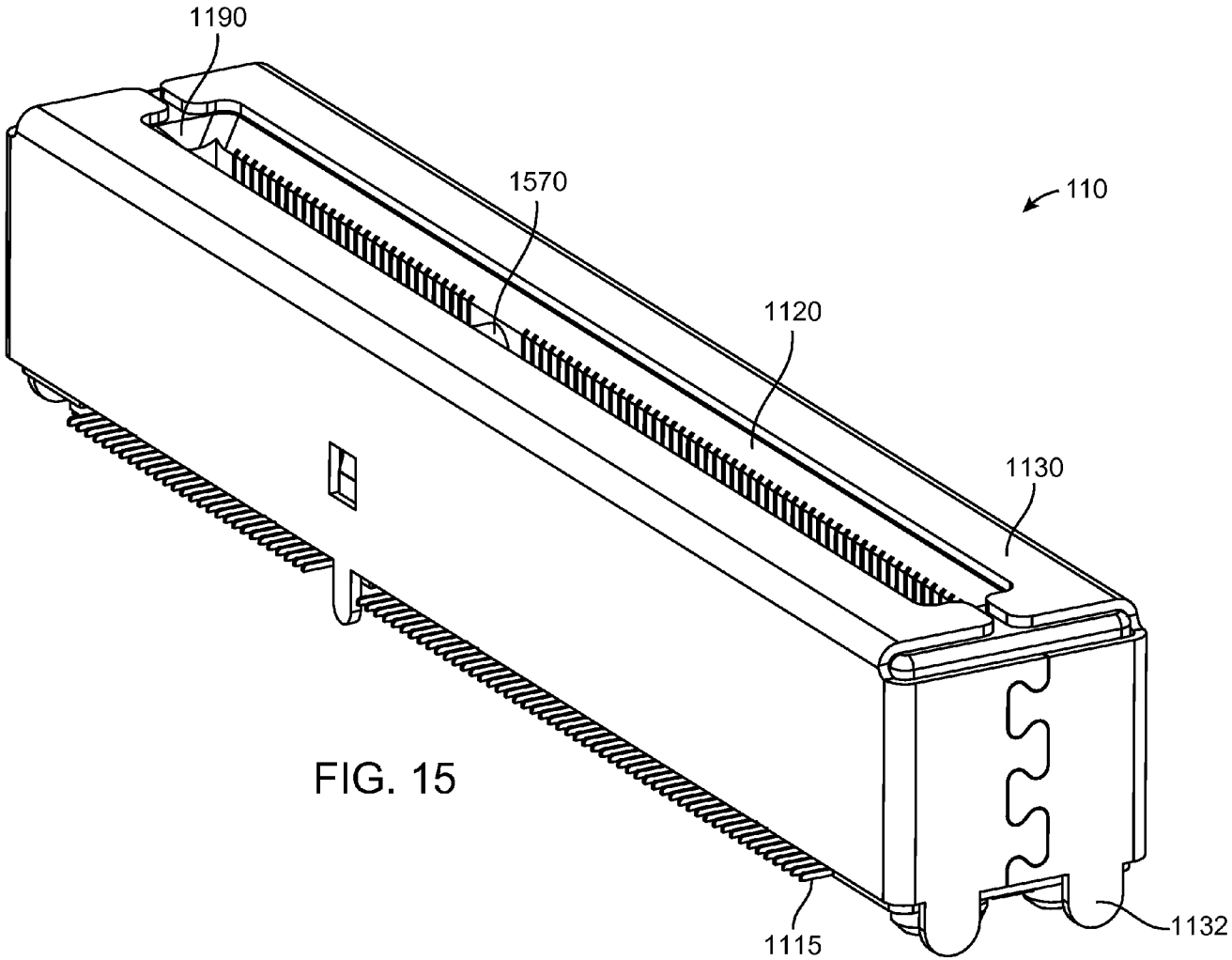
FIG. 15 illustrates a card edge connector according to an embodiment of the present invention.

FIG. 15 illustrates a card edge connector according to an embodiment of the present invention. Card edge connector 110 may include an opening 1190 to accept a card (not shown.) A key 1570 may be used to ensure the card is inserted in a proper orientation. Shield 1130 may at least partially surround housing 1120. Tabs 1132 may be inserted into corresponding slots on a printed circuit board and soldered, for example, to ground traces. Surface-mount contacts 1115 may emerge from outer sides of connector 110.

Again, shield 1130 may be connected to a ground of a board to which it is mounted via tabs 1132. That is, tabs 1132 may be inserted into openings on the board which may be plated with metal that is connected to ground. Tabs 1132 may be soldered to the plating of the openings to make an electrical connection between shield 1130 and ground. Also, as shown above, internal contacts 1110 and 1310 may include contacting portions, such as contacting portions 1112, 1132, and 1319, that make electrical connections to shield 1130. Contacts 1110 and 1310 may further connect to ground, thereby providing a ground path from the shield 1130, through contacts 1110 or 1310, to ground. This arrangement provides several parallel ground paths from shield 1130 to ground. In still other embodiments of the present invention, a conductor, such as a flexible or elastic conductor, may be used to connect shield 1130 to ground. Such a conductor may similarly be used to connect a ground on a card inserted into connector 110 to shield 1130.

Figure 16:
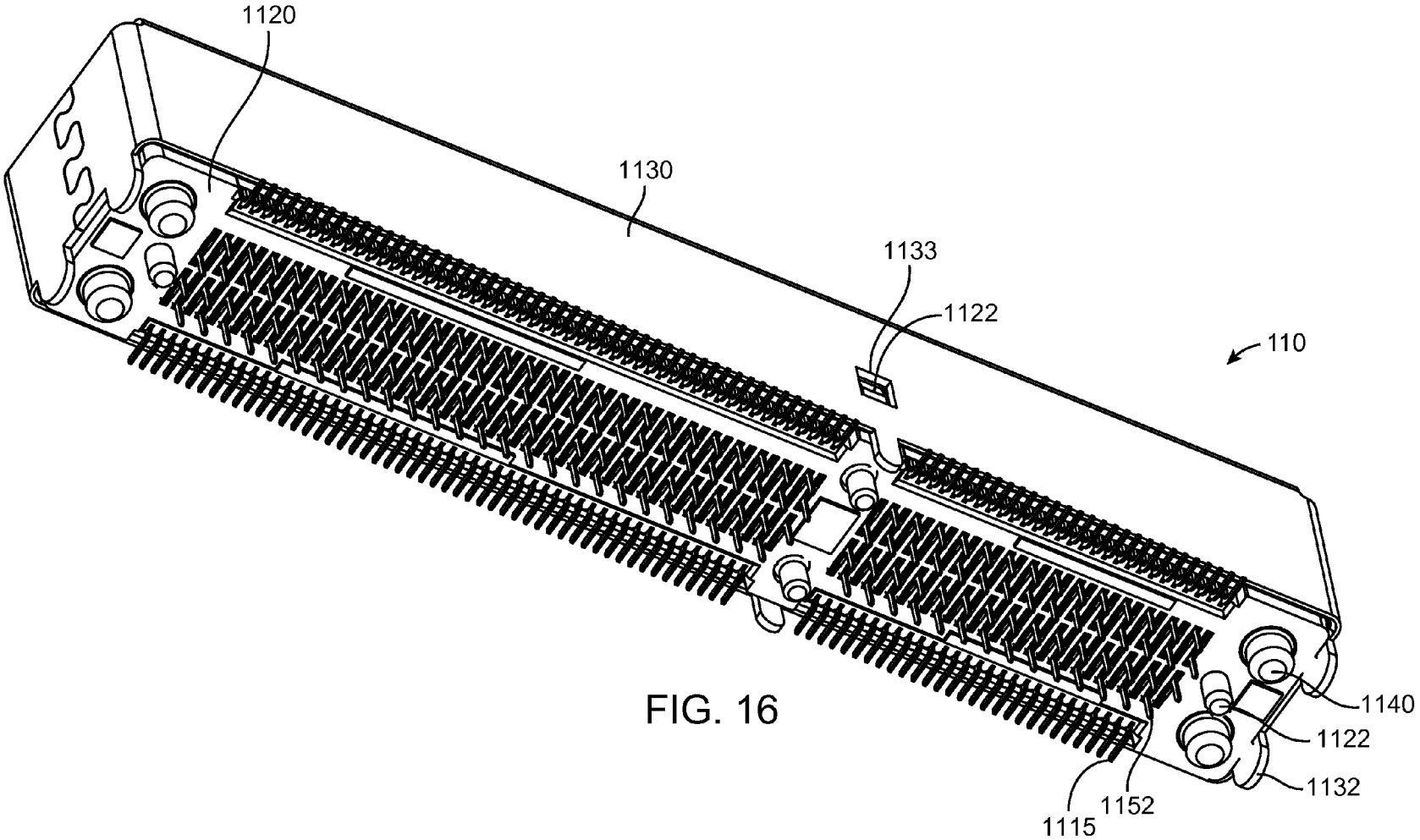
FIG. 16 illustrates an underside view of a card connector according to an embodiment of the present invention.

FIG. 16 illustrates an underside view of a card connector according to an embodiment of the present invention. Connector 110 may include shield 1130 at least partially around housing 1120. Metal pins 1140 may be inserted into housing 1120 for increased mechanical strength. Housing 1120 may include posts 1122 for additional increased mechanical stability. Shield 1130 may include opening 1133 to accept tab 1122 on housing 1120.

Outer surface-mount contacting portions 1115 and inner through-hole contacting portions 1152 may emerge from the underside of connector 110. Surface-mount contacting portions 1115 may emerge from the underside of the connector near an edge of the connector 110 and extend away from the connector 110, and may be soldered to corresponding contacts on a surface of a printed circuit board. Through-hole contacting portions 1152 may emerge from the underside of the connector near a center of the connector and may be inserted into corresponding holes in a printed circuit board.

This arrangement may facilitate inspection of the finished product. Specifically, surface-mount contacts 1115 are readily visible along edges of connector 110. Through-hole contact portions 1152 may be inspected by viewing an underside of a printed circuit board supporting connector 110. If through-hole contact portions 1152 were instead surface-mount contacting portions, they would not be visible for inspection. Further, having that many rows of surface-mount contact portions would greatly increase the co-planarity requirement that would result from a pure surface mount design. Not exceeding two rows of surface-mount contact portions helps to avoid the difficulty of aligning a high number of surface-mount contact portions to a single plane.

It should be noted that inspection could also be accomplished by making all contacting portions through-hole contact portions. For example, surface-mount contacting portions 1115 could be replaced with through-hole contact portions and all contacts could be inspected. However, the use of through-holes near the edges of the connector 110 would block route paths from through-hole contact portions 1152 through a printed circuit board on which connector 110 is mounted. Also, the use of this many through-hole contacts would result in a high true position requirement. Using a mix of surface-mount and through-hole contact portions relaxes the requirement for co-planarity or positioning that would result from a design that uses only surface-mount or through-hole contact portions.

Figure 17:
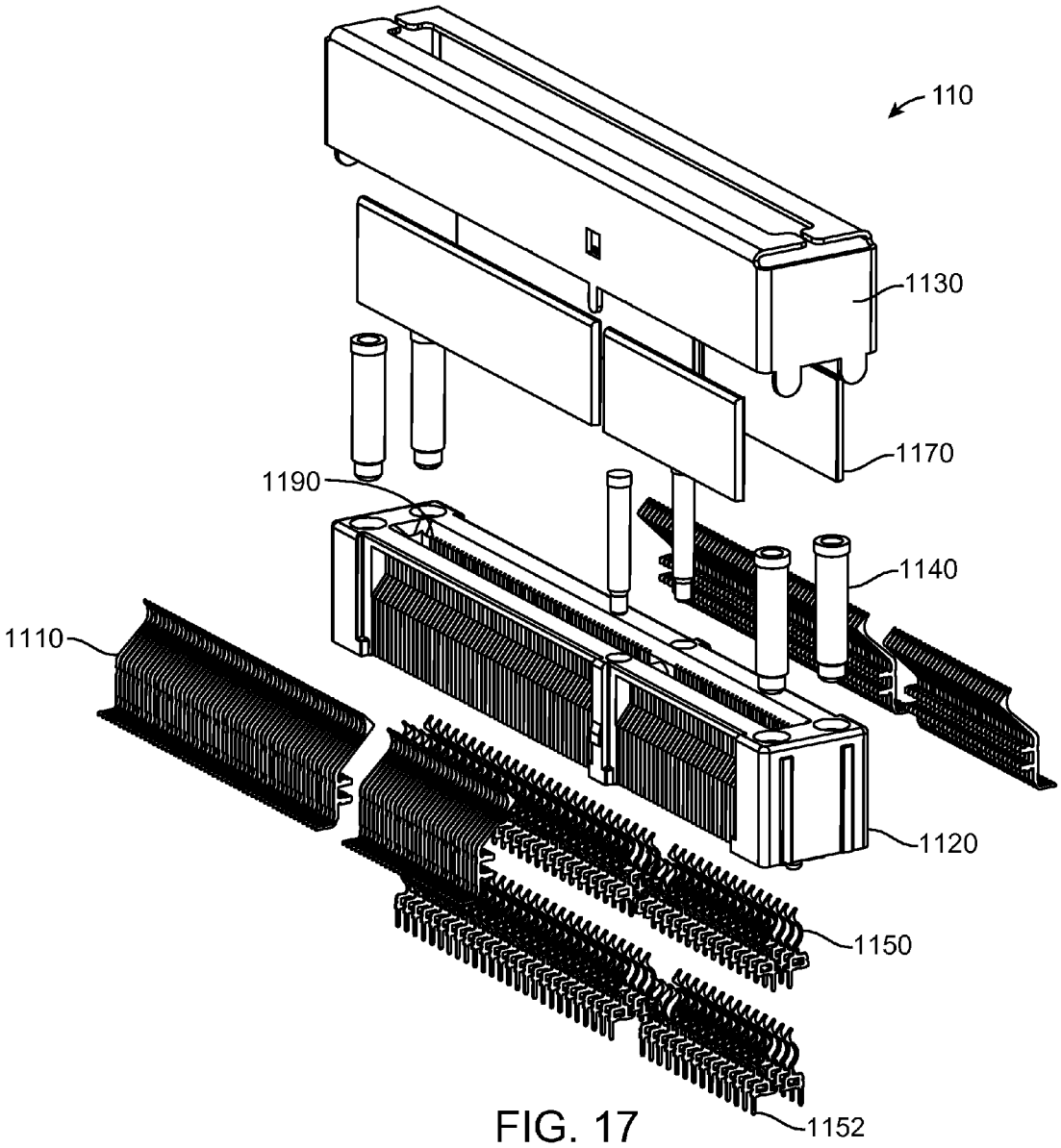
FIG. 17 is an exploded view of a connector according to an embodiment of the present invention.

FIG. 17 is an exploded view of a connector according to an embodiment of the present invention. This connector may include housing 1120. Contacts 1110 may be inserted into slots in the outside sides of housing 1120. Contacts 1150 may be inserted into sides of central passage 1190. Metal pins 1140 may be inserted into housing 1120 for stability. Side panels 1170 may be fitted along sides of housing 1120 to provide mechanical support for contacts 1110. A shell or shield 1130 may be placed over housing 1120. The tops of pins 1140 may be spot or laser welded to shell or shield 1130.

Again, contacts 1150 may include through-hole contacting portions 1152. However, there are physical limitations as to how close through holes can be located on a printed circuit board. Accordingly, embodiments of the present invention alternate the positions of these through-hole portions 1152 in order to spread out their locations. This may aid in the manufacture of a printed circuit board designed to have this connector reside on it. An example is shown in the following figure.

Figure 18:
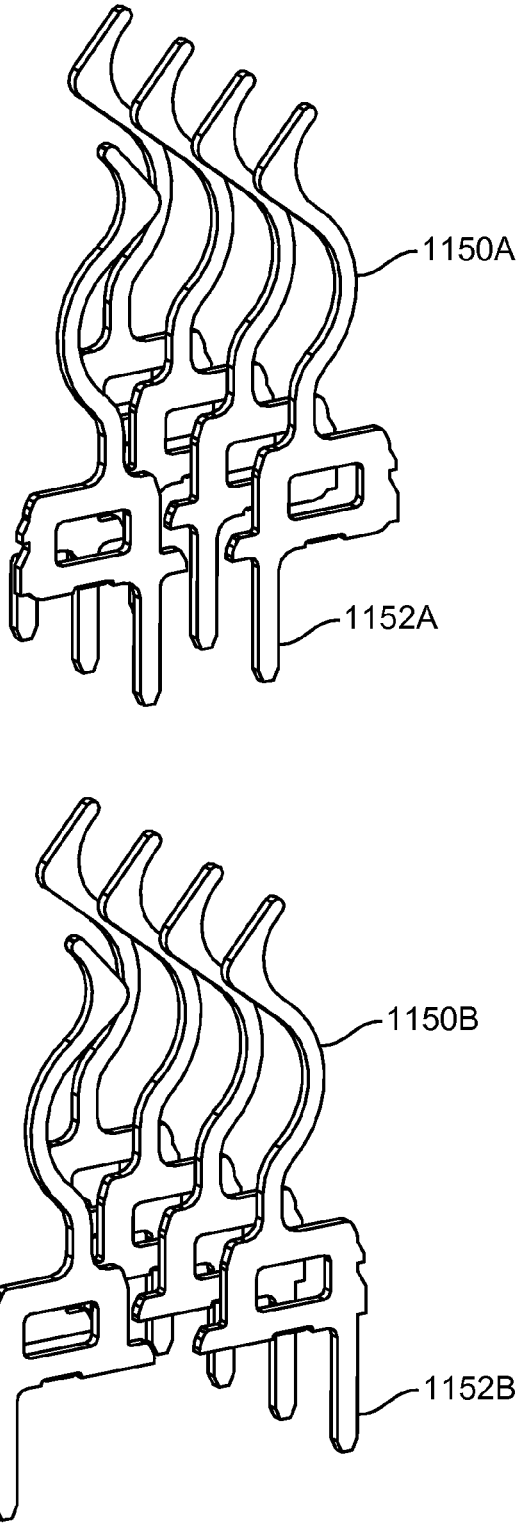
FIG. 18 illustrates contacts that may be used in a connector according to an embodiment of the present invention.

FIG. 18 illustrates contacts that may be used in a connector according to an embodiment of the present invention. In this example, contacts 1150 are implemented as two types of contacts 1150A and 1150B. Contacts 1150A have through-hole portions 1152A towards a center of a housing, while contacts 1150B have through-hole portions emerging near an outside of the housing. Contacts 1150A and 1150B may be alternated such that through portions 1152A and 1152B may alternate. This increases spacing between through-hole portions and simplifies the manufacturing of a printed circuit board designed to receive the connector.

Again, embodiments of the present invention may provide connectors having conductive or nonconductive shells or shields. A conductive shield may contact contacting portions of contacts inside the connector, thus providing good ground shielding. However, when contacting portions of contacts are not used to contact a shield, a connecting shield may instead provide a pathway for increased signal coupling among contacts. In these situations, a nonconductive shell or shield may be used. Since either a shield or shell may be used, embodiments the present invention may provide a housing that may be used with either one. An example of such a housing is shown in the following figure.

Figure 19:
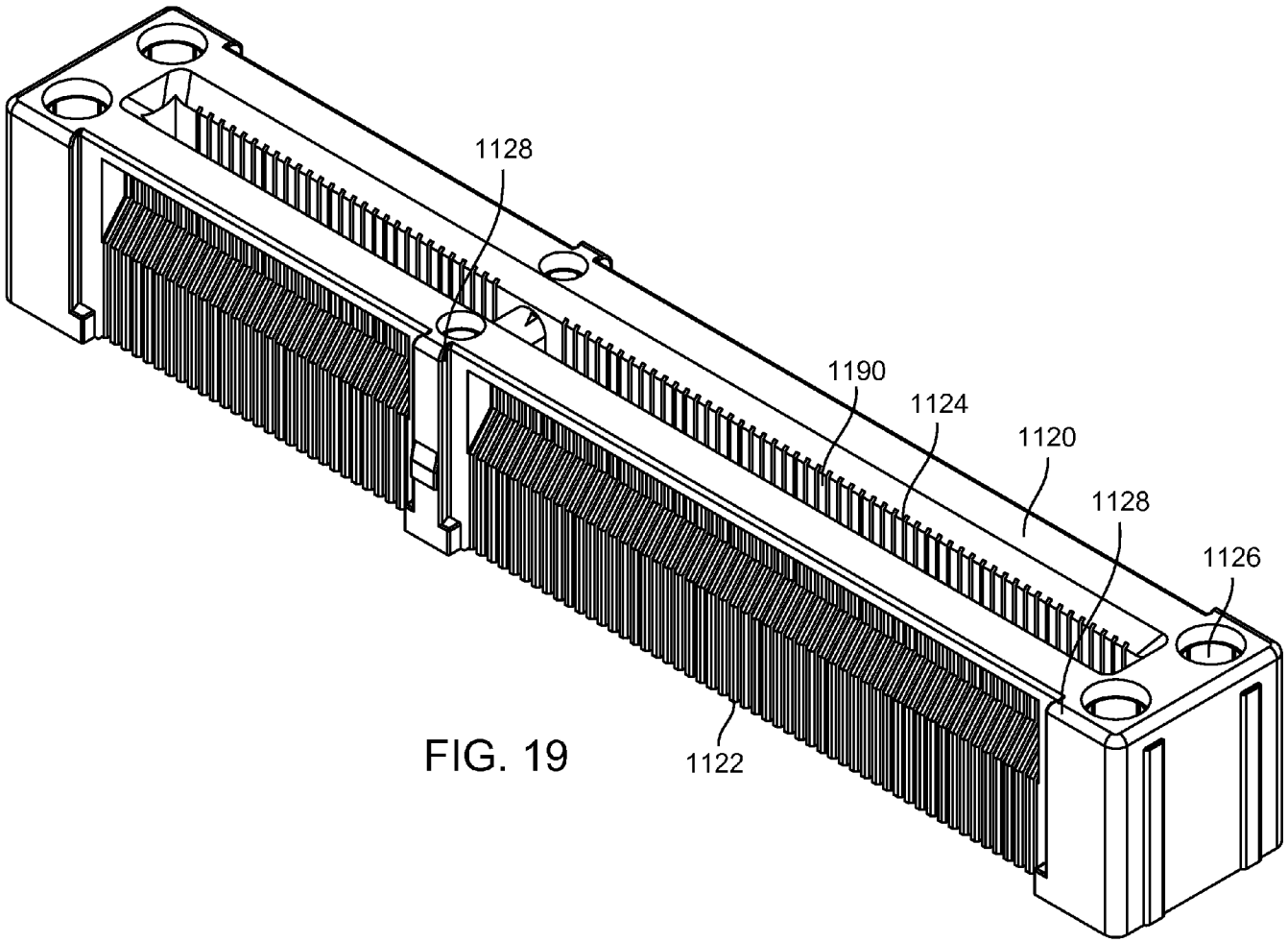
FIG. 19 illustrates a housing for a connector according to an embodiment of the present invention.

FIG. 19 illustrates a housing for a connector according to an embodiment of the present invention. Housing 1120 may include a central passage 1190 to accept a card. Housing 1120 may further include outside side slots 1122 and slots 1124 to accept contacts. Housing 1120 may further include openings 1126 for metal or other types of pins, which may be used for increased mechanical support. Dovetailed portions 1128 may be used to secure side panels to housing 1120. In this configuration, housing 1120, contacts, pins, and side panels may be at least partially covered by a conductive shield or shell. In other embodiments, this configuration may be covered with a nonconductive shield or shell. A nonconductive shield or shell may be placed over housing 1120 either before or after a reflow step in the manufacturing process. By putting a nonconductive shell over housing 1120 after the reflow process, the nonconductive shell avoids the heat that it would otherwise be exposed to during reflow. Again, the nonconductive shield may be stretched before it is placed over housing 1120. This may help secure contacts in place in housing 1120.

Again, dovetailed portions 1128 of housing 1120 may be used to secure side panels 1170 in place. An example is shown in the following figure.

Figure 20:
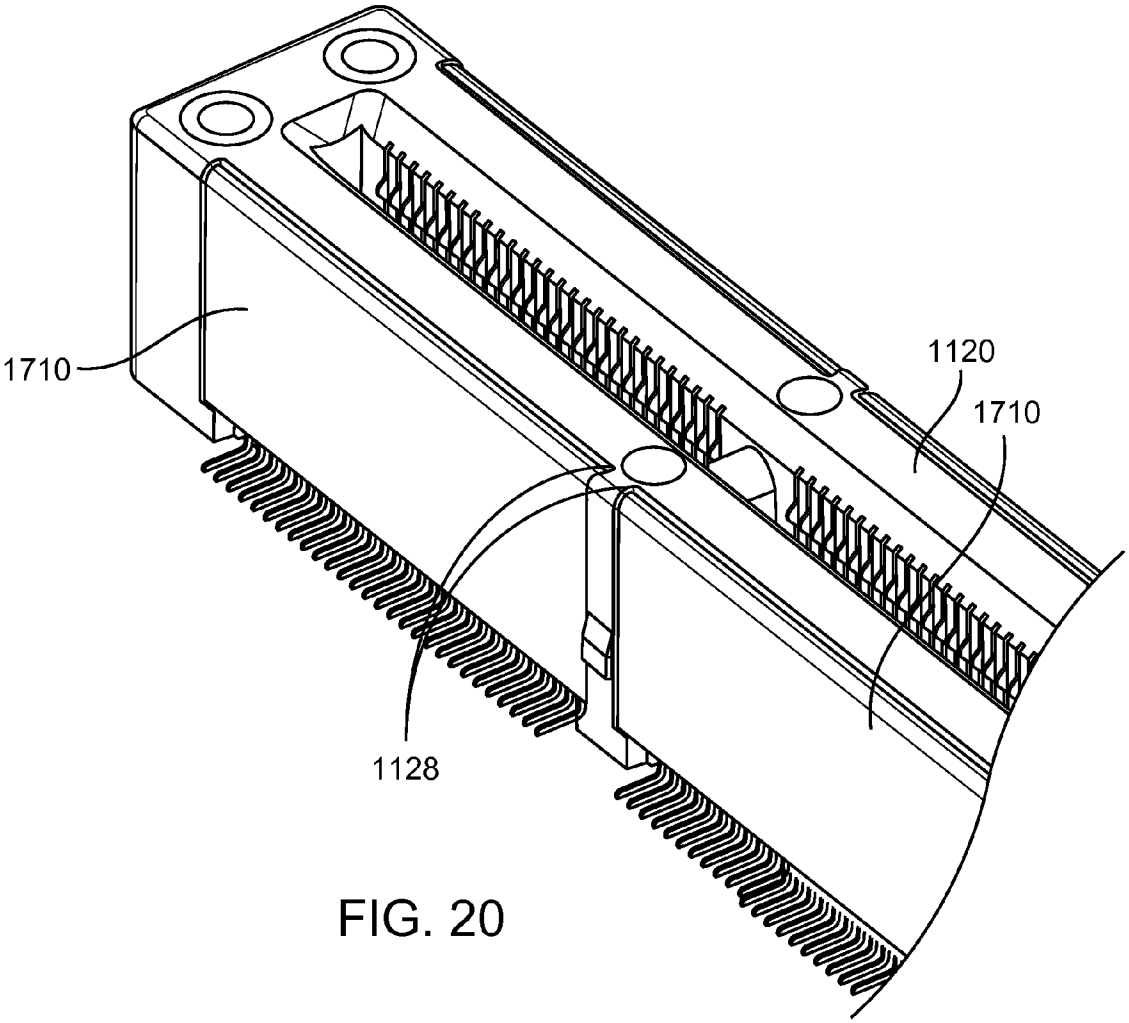
FIG. 20 illustrates side panels on a housing of a connector according to an embodiment of the present invention.

FIG. 20 illustrates side panels on a housing of a connector according to an embodiment of the present invention. Again, dovetailed portions 1128 may secure side panels 1170 in place. Side panel 1170 may be nonconductive to electrically insulate contacts from a conductive shell or shield and from each other.

Again, embodiments of the present invention may provide a connector having a nonconductive shell. An example is shown in the following figure.

Figure 21:
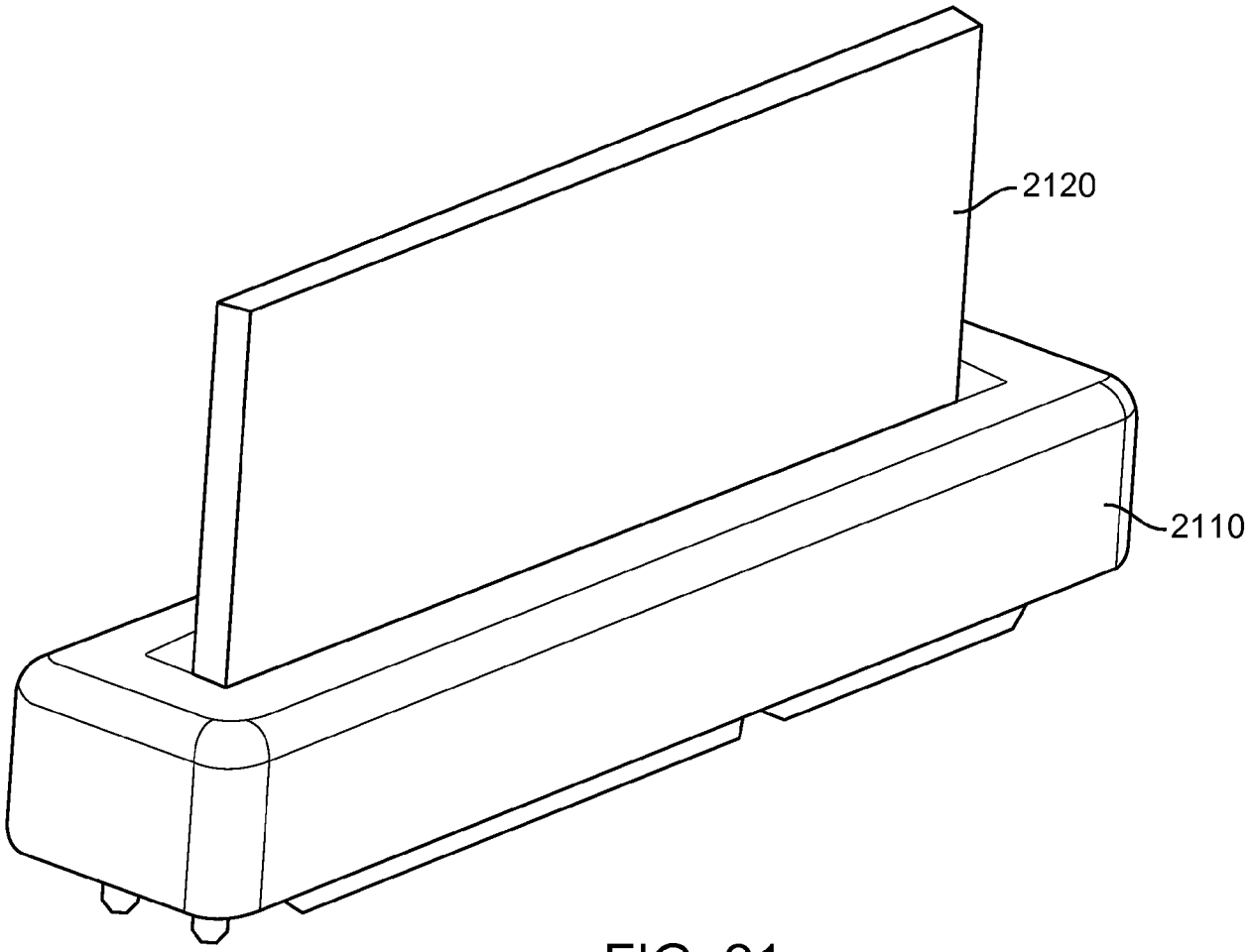
FIG. 21 illustrates a connector according to an embodiment of the present invention.

FIG. 21 illustrates a connector according to an embodiment of the present invention. In this example, the connector has a nonconductive shell 2110. A card 2120 is shown as being inserted into the connector.

Figure 22:
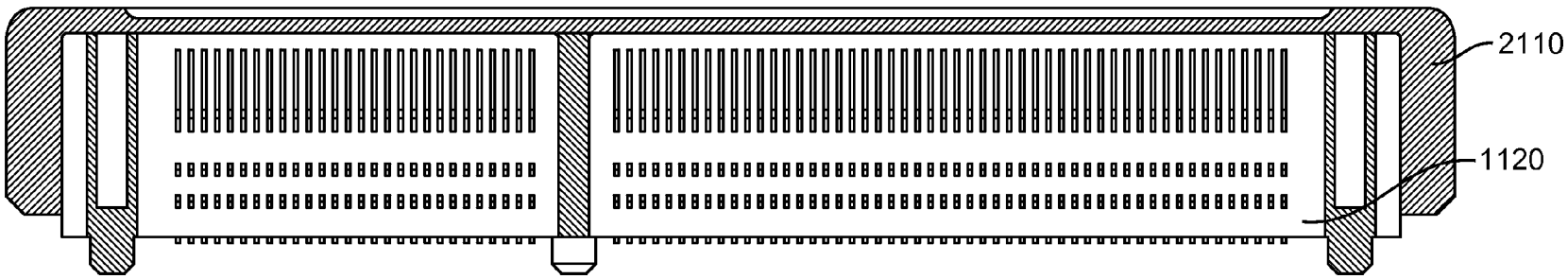
FIG. 22 illustrates a side view of a connector having a nonconductive shield.

FIG. 22 illustrates a side view of a connector having a nonconductive shield. In this example, nonconductive shell 2110 at least partially surrounds housing 1120.

Again, embodiments of the present invention may optionally include one or more metal pins in a housing to provide additional mechanical stability. An example is shown in the following figure.

Figure 23:
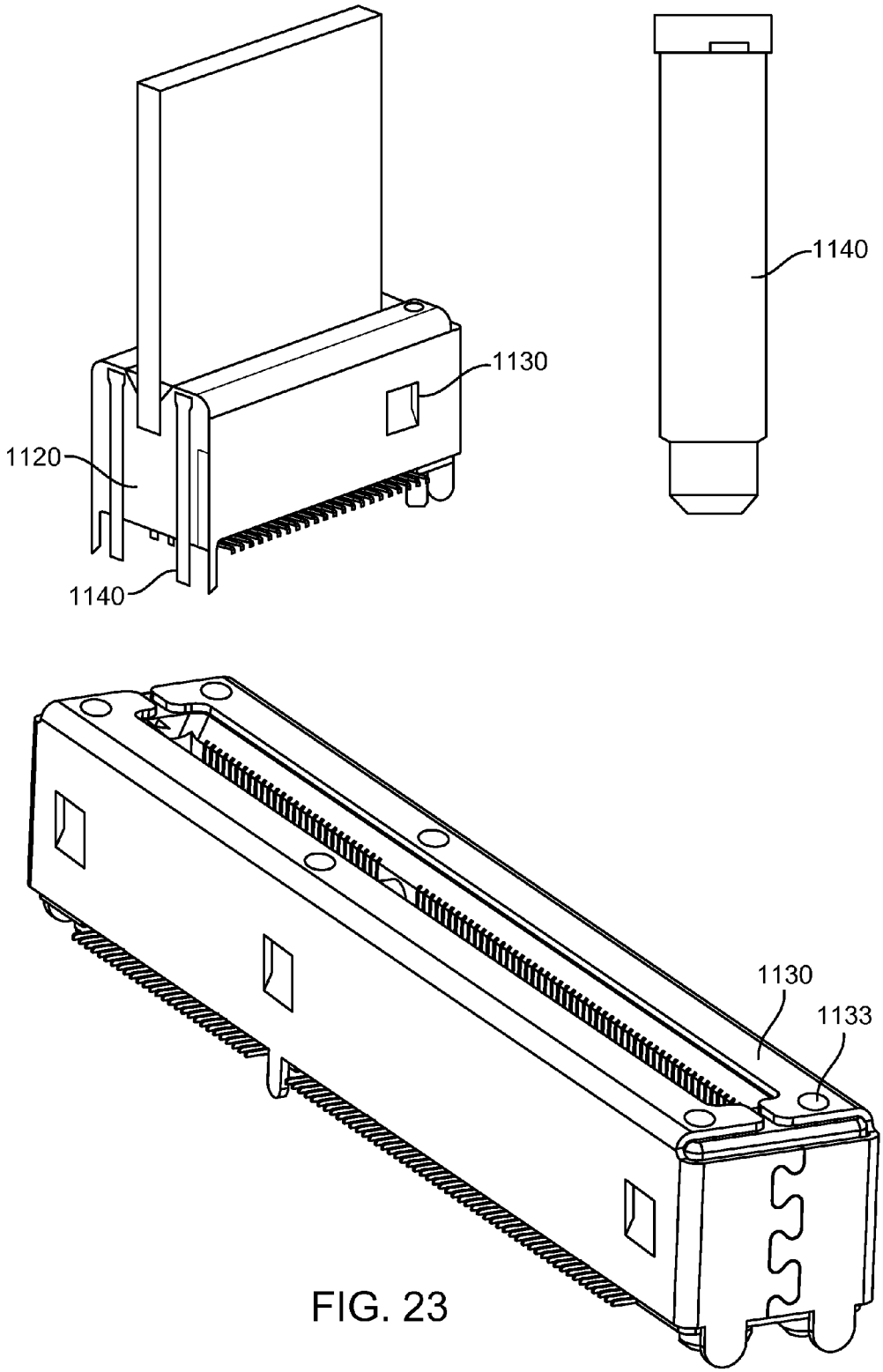
FIG. 23 illustrates a metal pin for a connector according to an embodiment of the present invention.

FIG. 23 illustrates a metal pin for a connector according to an embodiment of the present invention. As shown before, pin 1140 may be inserted into housing 1120. When connector shielding 1130 is placed over housing 1120, a top of pin 1140 may be spot or laser welded at point 1133 to conductive shield 1130.

Again, embodiments of the present invention may include one or more keying features to assure that a card is inserted properly into the connector. In various embodiments of the present invention, this keying feature may be formed of metal to provide additional stability and mechanical support. An example is shown in the following figure.

Figure 24:
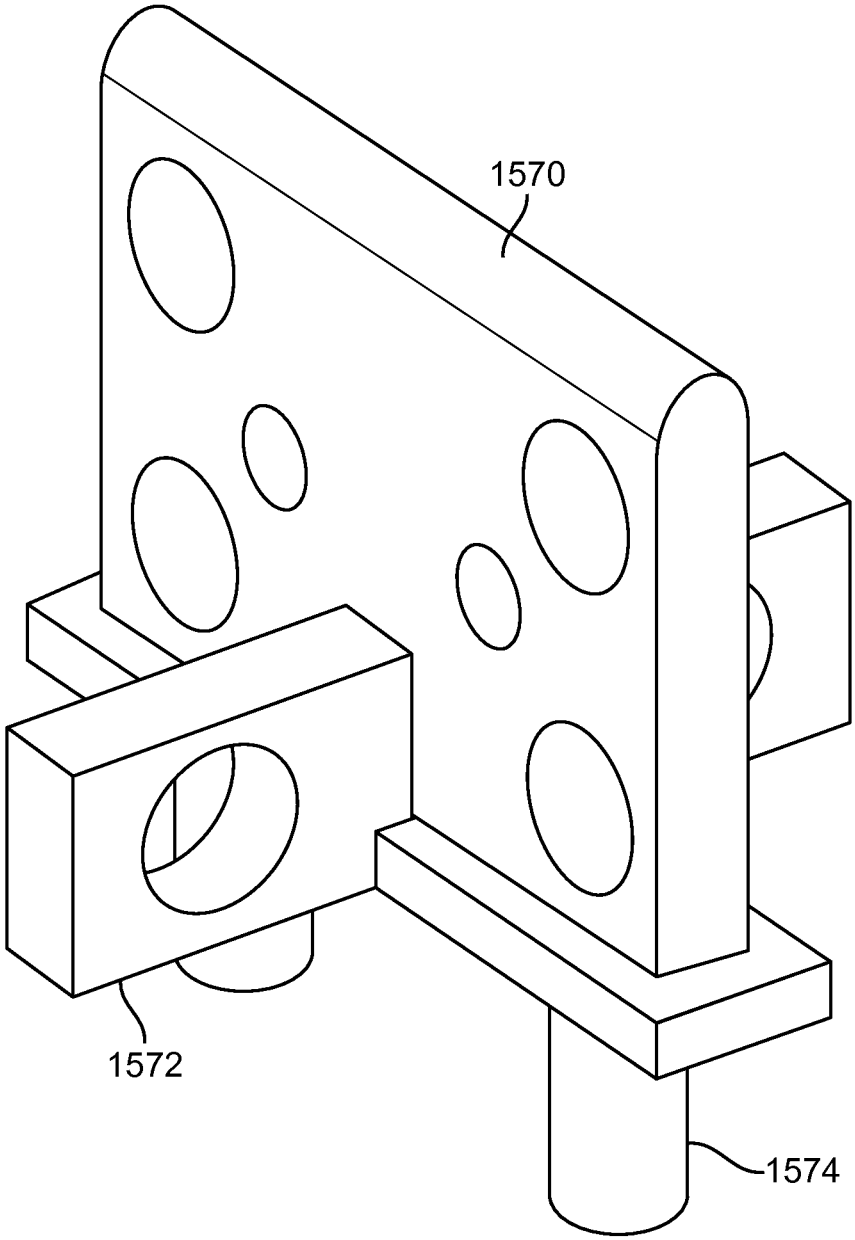
FIG. 24 illustrates a keying feature for a connector according to an embodiment of the present invention.

FIG. 24 illustrates a keying feature for a connector according to an embodiment of the present invention. Keying feature 1570 may be formed of metal or other durable material. Keying feature 1570 may include tabs 1572, which may insert into corresponding slots in a housing, such as housing 1120. Keying feature 1570 may further include posts 1574. Posts 1574 may be inserted and soldered to openings on a printed circuit board.

In various embodiments of the present invention, connectors may be formed of various materials. For example, a housing for a connector may be formed of one or more types of plastics, nylons, or other materials or combination of materials. The contact pins and ground tabs for the connector may be formed of stainless steel, copper, brass, aluminum, or other materials or combination of materials. These contact pins and ground tabs may be at least partially plated with nickel, gold, palladium-nickel, or other plating materials or combination of materials.

In various embodiments of the present invention, signal isolation may be improved and crosstalk reduced through selective use of these materials. For example, some plastics and other materials may have dielectric constants that are three to four times that of air. Accordingly, the use of such materials in a housing for connector 110 may increase pin-to-pin capacitance or coupling capacitance. Such an increase may be useful between differential signal pairs, such as DP4 and DN4 in the example in FIG. 10. Specifically, coupling these lines together may increase their common-mode rejection of unassociated signals and may help to provide a desired impedance.

While an increase in coupling capacitance may be useful between contact pins for signals of a differential pair, it may not be useful between contact pins for signals of different differential pairs or between contact pins for signals of a differential pair and ground or other unassociated signal. Specifically, such an increase in coupling capacitance may increase crosstalk or slow edge rates. In such a situation, embodiments of the present invention may use an air gap, or a lower-dielectric material, between these contact pins. These air gaps or areas of lower-dielectric material may also be placed between rows of contact pins. By using higher-dielectric material between contact pins for differential signal pairs and lower-dielectric material or air gaps between contact pins for differential pairs and grounds, and between rows of contact pins, coupling may be concentrated between contact pins for signals in differential pairs and reduced elsewhere. It should be noted that in various embodiments of the present invention, the use of air gaps or lower-dielectric materials may be limited by the need for a certain level of mechanical stability and durability.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a housing having a slot, the slot forming an opening in a top surface;

a first row of contacts having contacting portions in a first side of the slot;

a second row of contacts having contacting portions in the first side of the slot between the first row of contacts and the opening;

a third row of contacts having contacting portions in a second side of the slot; and a fourth row of contacts having contacting portions in the second side of the slot between the third row of contacts and the opening, wherein each of the contacts further comprises a contacting portion emerging from a bottom of the housing, and wherein the contacting portions for each contact in the second row of contacts and the fourth row of contacts are each surface-mount contacts and the contacting portions of each contact in the first row of contacts and the third row of contacts are through-hole contacts.

2. The connector of claim 1 further comprising ground tabs in the housing and substantially beneath the slot.

3. The connector of claim 2 wherein each of the ground tabs comprises a contacting portion emerging from a bottom of the housing.

4. The connector of claim 1 wherein the slot is configured to receive a riser board having a plurality of surface contacts.

5. The connector of claim 4 wherein a bottom of the connector is adapted to mate with a printed circuit board.

6. The connector of claim 4 wherein a bottom of the connector is adapted to mate with a flexible circuit board.

7. The connector of claim 1 wherein at least one of the contacts in the first row of contacts includes one or more barbs to extend into the housing, the barbs including one or more teeth along an edge of the barb.

8. The connector of claim 1 further comprising side panels inserted into notches in the housing over the first outside side and the second outside side of the housing.

9. A connector comprising:

a housing having a central passage to accept a card, the central passage having a first side and a second side, the housing further having a first outside side and a second outside side;

a first plurality of contacts inserted into slots in the first outside side and the second outside side of the housing to form a first row of contacts on the first side and the second side of the central passage, wherein at least one of the first plurality of contacts includes one or more barbs to extend into the housing, the barbs including one or more teeth along an edge of the barb;

a second plurality of contacts inserted into slots in the first side and the second side of the central passage to form a second row of contacts on the first side and the second side of the central passage; and side panels inserted into notches in the housing over the first outside side and the second outside side of the housing.

10. The connector of claim 9 wherein the second plurality of contacts include contacts of a first type and a second type, where a difference between the first type and the second type is a position of a through-hole contact portion.

11. The connector of claim 9 wherein side panels are insulated.

12. The connector of claim 11 wherein the side panels are secured in place using dovetailed notches in the housing.

13. The connector of claim 9 further comprising:

metal pins inserted through the housing; and a shield over the housing and attached to tops of the metal pins.

14. The connector of claim 9 wherein the one or more barbs includes an upper barb having one or more teeth along a top edge and a lower barb having one or more teeth along a bottom edge.

15. The connector of claim 9 wherein the upper barb and the lower barb are angled upward.

16. The connector of claim 9 wherein each of the first plurality of contacts further comprises a surface-mount contact portion emerging from a bottom of the housing near an edge of the housing and extending away from the housing, and each of the second plurality of contacts further comprises a through-hold contact portion emerging from a bottom of the housing near a center of the housing.

17. A method of manufacturing a robust connector, the method comprising:

receiving a housing having a central passage to accept a card, the central passage having a first side and a second side, the housing further having a first outside side and a second outside side;

inserting a first plurality of contacts into slots in the first outside side and the second outside side of the housing to form a first row of contacts on the first side and the second side of the central passage, wherein at least one of the first plurality of contacts include one or more barbs to extend into the housing, the barbs including one or more teeth along an edge of the barb;

inserting a second plurality of contacts into slots in the first side and the second side of the central passage to form a second row of contacts on the first side and the second side of the central passage; and inserting side panels over the first outside side and the second outside side of the housing.

18. The method of claim 17 wherein the second plurality of contacts include contacts of a first type and a second type, where a difference between the first type and the second type is a position of a contact tail.

19. The method of claim 17 wherein the side panels are insulated.

20. The method of claim 19 further comprising securing the side panels in place using dovetailed notches in the housing.

21. The method of claim 17 further comprising:

inserting metal pins through the housing;

placing a shield over the housing; and attaching the shield to tops of the metal pins.

* * * * *